US011688320B2

(12) United States Patent
Kim et al.

(10) Patent No.: US 11,688,320 B2
(45) Date of Patent: Jun. 27, 2023

(54) GAMMA AMPLIFIER INCLUDING TRACK PERIOD, AND GAMMA VOLTAGE GENERATOR HAVING THE SAME

(71) Applicant: Samsung Electronics Co., Ltd., Suwon-si (KR)

(72) Inventors: In-Suk Kim, Suwon-si (KR); Yeonjeong Lee, Yongin-si (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 0 days.

(21) Appl. No.: 17/704,595

(22) Filed: Mar. 25, 2022

(65) Prior Publication Data

US 2023/0063319 A1 Mar. 2, 2023

(30) Foreign Application Priority Data

Aug. 27, 2021 (KR) ..... 10-2021-0113576

(51) Int. Cl.
*G09G 3/20* (2006.01)

(52) U.S. Cl.
CPC ..... *G09G 3/20* (2013.01); *G09G 2310/0291* (2013.01); *G09G 2310/0294* (2013.01); *G09G 2310/08* (2013.01); *G09G 2320/0276* (2013.01); *G09G 2320/0673* (2013.01)

(58) Field of Classification Search
CPC ..... G09G 3/20; G09G 2310/0291; G09G 2310/0294; G09G 2310/08; G09G 2320/0276; G09G 2320/0673
See application file for complete search history.

(56) References Cited

U.S. PATENT DOCUMENTS

| | | | | |
|---|---|---|---|---|
| 7,783,105 | B2 | 8/2010 | Moore et al. | |
| 8,115,756 | B2 | 2/2012 | Wu et al. | |
| 8,624,765 | B2 | 1/2014 | Watanabe | |
| 8,860,767 | B2 | 10/2014 | Yu et al. | |
| 10,037,731 | B2 | 7/2018 | Kawano | |
| 2009/0051676 | A1* | 2/2009 | Cho | G09G 3/20 341/144 |

(Continued)

FOREIGN PATENT DOCUMENTS

| | | | |
|---|---|---|---|
| JP | 2010-055684 | A | 3/2010 |
| JP | 5321739 | B2 | 10/2013 |

(Continued)

*Primary Examiner* — Kenneth Bukowski
(74) *Attorney, Agent, or Firm* — Harness, Dickey & Pierce, P.L.C.

(57) ABSTRACT

Disclosed is a gamma amplifier which includes a first amplification device that receives a first input signal during a first track period in a first time period, compensates for a first offset voltage from the first input signal during a first compensation period in the first time period, and generates a first output signal during a second time period after the first time period based on a control signal, and a second amplification device that receives a second input signal during a second track period in the second time period, compensates for a second offset voltage from the second input signal during a second compensation period in the second time period, and generates a second output signal during a third time period after the second time period based on the control signal and processing circuitry configured to generate the control signal.

20 Claims, 15 Drawing Sheets

(56) References Cited

U.S. PATENT DOCUMENTS

| | | | | |
|---|---|---|---|---|
| 2015/0222252 | A1* | 8/2015 | Kim | H03F 3/3022<br>327/307 |
| 2020/0234624 | A1* | 7/2020 | Lim | G09G 3/20 |
| 2021/0366344 | A1* | 11/2021 | Chung | H03F 3/45183 |

FOREIGN PATENT DOCUMENTS

| | | | |
|---|---|---|---|
| JP | 5417762 | B2 | 2/2014 |
| JP | 6736834 | B2 | 8/2020 |
| KR | 10-1297793 | B1 | 8/2013 |
| KR | 10-1352189 | B1 | 1/2014 |
| KR | 10-1448853 | B1 | 10/2014 |

* cited by examiner

FIG. 10

| Simulation Condition | Gamma Amplification Circuit with offset compensation | Gamma Amplification Circuit without offset compensation |
|---|---|---|
| Average | 3.9998[V] | 4.0000[V] |
| Standard Deviation | $2.6291*10^{-4}$[V] | $1.1504*10^{-3}$[V] |
| Min Value | 3.9990[V] | 3.9966[V] |
| Max Value | 4.0007[V] | 4.0033[V] |

GAMMA AMPLIFIER INCLUDING TRACK PERIOD, AND GAMMA VOLTAGE GENERATOR HAVING THE SAME

CROSS-REFERENCE TO RELATED APPLICATIONS

This application claims priority under 35 U.S.C. § 119 to Korean Patent Application No. 10-2021-0113576 filed on Aug. 27, 2021, in the Korean Intellectual Property Office, the disclosures of which are incorporated by reference herein in their entireties.

BACKGROUND

Embodiments of the present disclosure described herein relate to a display driver circuit, and more particularly, relate to a gamma amplifier including a track period and a gamma voltage generator including the same.

A display device refers to a device that displays, to a user, an image corresponding to image data. Currently, flat display devices, whose size and weight are smaller than those of a cathode ray tube (CRT), are mainly being used. For example, flat panel display devices may be implemented with a liquid crystal display (LCD), a field emission display (FED), a plasma display panel (PDP), an organic light emitting display (OLED), or the like.

In general, a display device includes a display panel and a driver circuit. The display panel includes a plurality of pixels. The driver circuit may control brightness of each of the plurality of pixels to display an image corresponding to image data. Actual luminance of image data and luminance perceived by the user's eye may be different. To compensate for the difference, the driver circuit may include a gamma voltage generator that generates a gamma curve.

SUMMARY

Embodiments of the present disclosure provide a gamma amplifier including a track period and a gamma voltage generator including the same. It is advantageous to have a gamma voltage generator that has a reduced chip size and divides the gamma curve at fine and accurate intervals. Some example embodiments of the present disclosure include these advantages.

According to an embodiment, an apparatus includes a first amplification device that receives a first input signal having an input voltage level during a first track period in a first time period, compensates for a first offset voltage from the first input signal during a first compensation period in the first time period based on a control signal, and generates a first output signal having a gamma tab voltage level during a second time period after the first time period based on the control signal, and a second amplification device that receives a second input signal having the input voltage level during a second track period in the second time period, compensates for a second offset voltage from the second input signal during a second compensation period in the second time period based on the control signal, and generates a second output signal having the gamma tab voltage level during a third time period after the second time period based on the control signal. Processing circuitry configured to generate the control signal and control when the first input signal and the second input signals are received by the first amplification device and the second amplification device, respectively.

According to an embodiment, an apparatus includes a first switch that is connected between an input node arranged for receiving a first input signal having an input voltage level during a first track period in a first time period and a first node and is turned on during the first track period based on a control signal, a first capacitor that is connected between the first node and a second node, a second switch that is connected between the second node and a third node and is turned on during the first track period based on the control signal, a third switch that is connected between the first node and the third node and is turned on during a first compensation period following the first track period and belonging to the first time period based on the control signal, a fourth switch that is connected between the first node and an output node arranged for outputting a first output signal having a gamma tab voltage level during a second time period after the first time period and is turned on during the second time period based on the control signal, a fifth switch that is connected between the third node and the output node and is turned on during the second time period based on the control signal, and a first amplifier that includes a first input terminal connected with the second node, a second input terminal arranged for receiving an amplification reference voltage, and a first output terminal connected with the third node. Processing circuitry is configured to generate the control signal and control when the first input signal is received at the input node.

According to an embodiment, an apparatus includes a tab selection circuit that generates an input signal having first to N-th input voltage levels respectively in first to N-th time periods of first to 2N-th time periods and having the first to N-th input voltage levels respectively in the (N+1)-th to 2N-th time periods of the first to 2N-th time periods, and first to N-th gamma amplifiers that operate based on the input signal. A first gamma amplifier of the first to N-th gamma amplifiers includes a first amplification device that receives the input signal during a first track period in the first time period of the first to 2N-th time periods and generates a first output signal having a first gamma tab voltage level during the second to (N+1)-th time periods of the first to 2N-th time periods based on a control signal, and a second amplification device that receives the input signal during a (N+1)-th track period in the (N+1)-th time period of the first to 2N-th time periods and generates a second output signal having the first gamma tab voltage level during the first time period and the (N+2)-th to 2N-th time periods of the first to 2N-th time periods based on a control signal. Processing circuitry is configured to generate the control signal. The first to 2N-th time periods are sequentially repeated, and "N" is a natural number.

BRIEF DESCRIPTION OF THE FIGURES

The above and other objects and features of the present disclosure will become apparent by describing in detail embodiments thereof with reference to the accompanying drawings.

FIG. 10 is a table describing a characteristic of an output signal of a gamma amplification circuit according to some embodiments of the present disclosure.

DETAILED DESCRIPTION

Below, embodiments of the present disclosure will be described in detail and clearly to such an extent that one skilled in the art easily carries out the present disclosure.

Components described in the detailed description with reference to terms "part", "unit", "module", "layer", etc. and function blocks illustrated in drawings may be implemented in the form of software, hardware, or a combination thereof. For example, the software may be a machine code, firmware, an embedded code, and application software. For example, the hardware may include an electrical circuit, an electronic circuit, a processor, a computer, an integrated circuit, integrated circuit cores, a pressure sensor, an inertial sensor, a microelectromechanical system (MEMS), a passive element, or a combination thereof.

Figure 1:
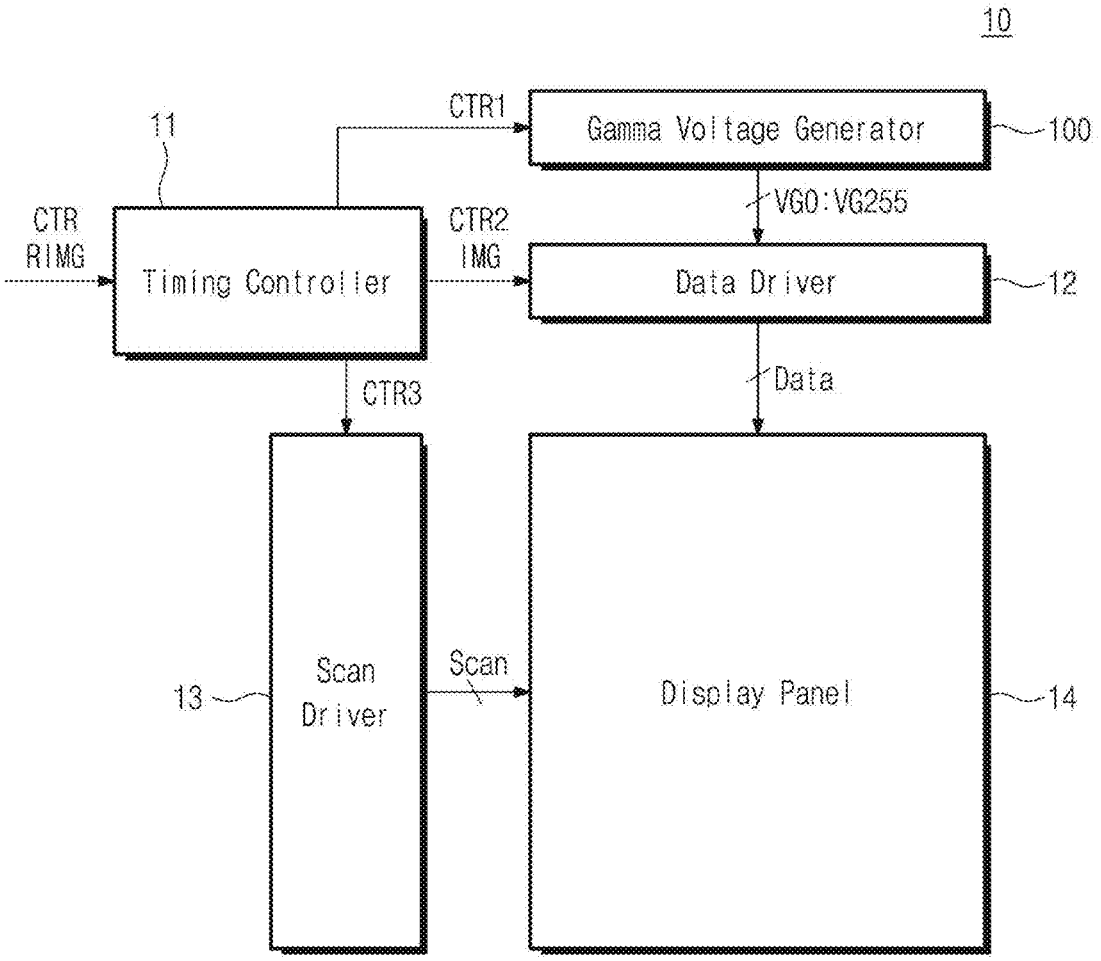
FIG. 1 is a block diagram of a display device according to an embodiment of the present disclosure.

FIG. 1 is a block diagram of a display device according to an embodiment of the present disclosure. Referring to FIG. 1, a display device 10 may receive image data from the outside and may display an image corresponding to the image data to a user. The display device 10 may include a timing controller 11, a data driver 12, a scan driver 13, a display panel 14, and a gamma voltage generator 100. The timing controller 11, the data driver 12, the scan driver 13, and the gamma voltage generator 100 may be driver circuits for driving the display panel 14.

The timing controller 11 may receive raw image data RIMG and a control signal CTR from an external device. The timing controller 11 may generate image data IMG, based on the raw image data RIMG. For example, the timing controller 11 may generate the image data IMG by applying an algorithm for correcting an image quality to the raw image data RIMG. The timing controller 11 may generate a first control signal CTR1, a second control signal CTR2, and a third control signal CTR3, based on the image data IMG and the control signal CTR. The timing controller 11 may control timings to drive the gamma voltage generator 100, the data driver 12, and the scan driver 13, based on the first to third control signals CTR1, CTR2, and CTR3.

The gamma voltage generator 100 may receive the first control signal CTR1 from the timing controller 11. The gamma voltage generator 100 may further receive a first reference voltage and a second reference voltage from the external device or a voltage regulator. The gamma voltage generator 100 may select an upper reference gamma voltage and a lower reference gamma voltage from voltages between the first reference voltage and the second reference voltage, based on the first control signal CTR1. The upper reference gamma voltage may correspond to a maximum gamma tab voltage level. The lower reference gamma voltage may correspond to a minimum gamma tab voltage level.

The gamma voltage generator 100 may determine a plurality of gamma tab voltage levels between the minimum gamma tab voltage level and the maximum gamma tab voltage level, based on the upper reference gamma voltage and the lower reference gamma voltage. The gamma voltage generator 100 may generate a plurality of gamma voltages VG0 to VG255 corresponding to a gamma curve, based on the minimum gamma tab voltage level, the maximum gamma tab voltage level, and the plurality of gamma tab voltage levels between the minimum gamma tab voltage level and the maximum gamma tab voltage level. The gamma curve may refer to a function that determines correlation between luminance of the image data IMG and luminance of an image to be displayed by the display device 10. For example, the human eye may be sensitive to a gray scale (or gradation) difference in a dark environment but may be insensitive to a gray scale (or gradation) difference in a bright environment. The gamma curve may non-linearly correct luminance of image data in consideration of a characteristic that the human eye perceives brightness. The gamma voltage generator 100 will be described in detail with reference to FIGS. 2 and 3.

The data driver 12 may receive the second control signal CTR2 and the image data IMG from the timing controller 11. The data driver 12 may receive the plurality of gamma voltages VG0 to VG255 from the gamma voltage generator 100. The data driver 12 may output a data signal to the display panel 14, based on the second control signal CTR2, the image data IMG, and the plurality of gamma voltages VG0 to VG255. The data signal may refer to a signal that controls brightness of the pixels of the display panel 14.

The scan driver 13 may receive the third control signal CTR3 from the timing controller 11. The scan driver 13 may output a scan signal to the display panel 14, based on the third control signal CTR3. The scan signal may refer to a signal that controls whether the pixels of the display panel 14 emit a light.

The display panel 14 may receive the data signal from the data driver 12. The display panel 14 may receive the scan signal from the scan driver 13. The display panel 14 may include the plurality of pixels. Each of the plurality of pixels may emit a light in response to the data signal and the scan signal. For example, the display panel 14 may include a plurality of scan lines extending in a first direction and a plurality of data lines extending in a second direction perpendicular to the first direction. The display panel 14 may include the plurality of pixels formed at intersections of the plurality of scan lines and the plurality of data lines. A pixel may emit a light, in response to a scan signal supplied through the corresponding scan line, according to a data signal supplied through the corresponding data line.

Figure 2:
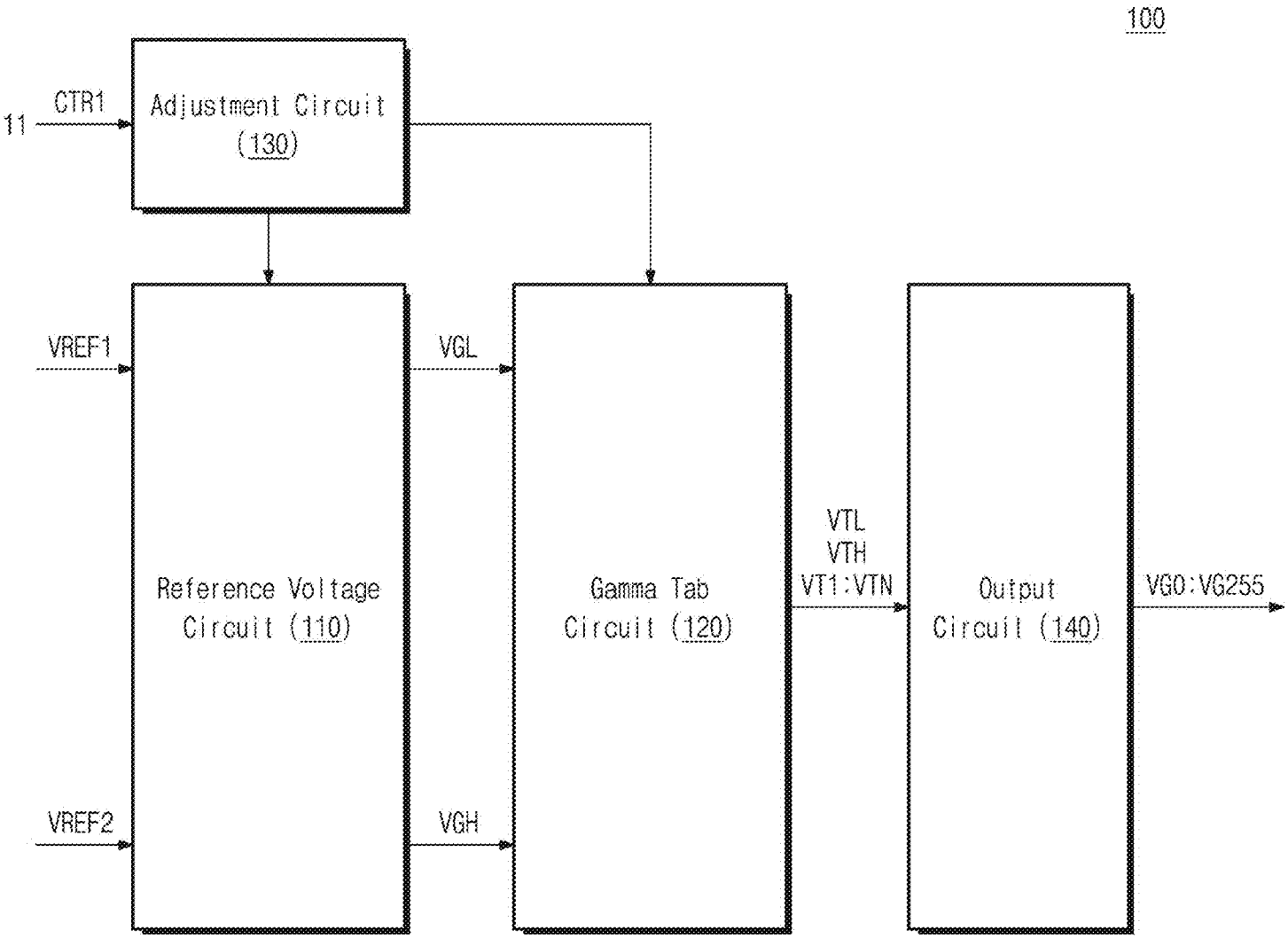
FIG. 2 is a block diagram illustrating a gamma voltage generator of FIG. 1 in detail, according to some embodiments of the present disclosure.

FIG. 2 is a block diagram illustrating a gamma voltage generator of FIG. 1 in detail, according to some embodiments of the present disclosure. Referring to FIGS. 1 and 2, the gamma voltage generator 100 may receive the first control signal CTR1 from the timing controller 11. The gamma voltage generator 100 may further receive a first reference voltage VREF1 and a second reference voltage VREF2 from the external device or the voltage regulator. A voltage level of the second reference voltage VREF2 may be higher than a voltage level of the first reference voltage VREF1. The gamma voltage generator 100 may generate the plurality of gamma voltages VG0 to VG255, based on the first control signal CTR1, the first reference voltage VREF1, and the second reference voltage VREF2. The gamma voltage generator 100 may include a reference voltage circuit 110, a gamma tab circuit 120, an adjustment circuit 130, and an output circuit 140.

The reference voltage circuit 110 may receive the first reference voltage VREF1 and the second reference voltage VREF2. Under control of the adjustment circuit 130, the reference voltage circuit 110 may determine an upper reference gamma voltage VGH and a lower reference gamma voltage VGL, based on the first reference voltage VREF1 and the second reference voltage VREF2.

The gamma tab circuit 120 may receive the upper reference gamma voltage VGH and the lower reference gamma voltage VGL from the reference voltage circuit 110. Under control of the adjustment circuit 130, the gamma tab circuit 120 may determine a minimum gamma tab voltage level VTL, a maximum gamma tab voltage level VTH, and a plurality of gamma tab voltage levels VT1 to VTN. Here, "N" is an arbitrary natural number. The minimum gamma tab voltage level VTL may correspond to the lower reference gamma voltage VGL. The maximum gamma tab voltage level VTH may correspond to the upper reference gamma voltage VGH. The plurality of gamma tab voltage levels VT1 to VTN may be voltage levels divided between the minimum gamma tab voltage level VTL and the maximum gamma tab voltage level VTH.

The adjustment circuit 130 may receive the first control signal CTR1 from the timing controller 11. The adjustment circuit 130 may control the reference voltage circuit 110 and the gamma tab circuit 120, based on the first control signal CTR1. For example, the adjustment circuit 130 may control an operation in which the reference voltage circuit 110 determines the upper reference gamma voltage VGH and the lower reference gamma voltage VGL, based on the first control signal CTR1. The adjustment circuit 130 may control an operation in which the gamma tab circuit 120 determines the plurality of gamma tab voltage levels VT1 to VTN, based on the first control signal CTR1.

The output circuit 140 may receive the minimum gamma tab voltage level VTL, the maximum gamma tab voltage level VTH, and the plurality of gamma tab voltage levels VT1 to VTN from the gamma tab circuit 120. The output circuit 140 may generate the plurality of gamma voltages VG0 to VG255, based on the minimum gamma tab voltage level VTL, the maximum gamma tab voltage level VTH, and the plurality of gamma tab voltage levels VT1 to VTN. The output circuit 140 may output the plurality of gamma voltages VG0 to VG255 to the data driver 12. The plurality of gamma voltages VG0 to VG255 may be used for the data driver 12 to correct luminance of the image data IMG.

Figure 3:
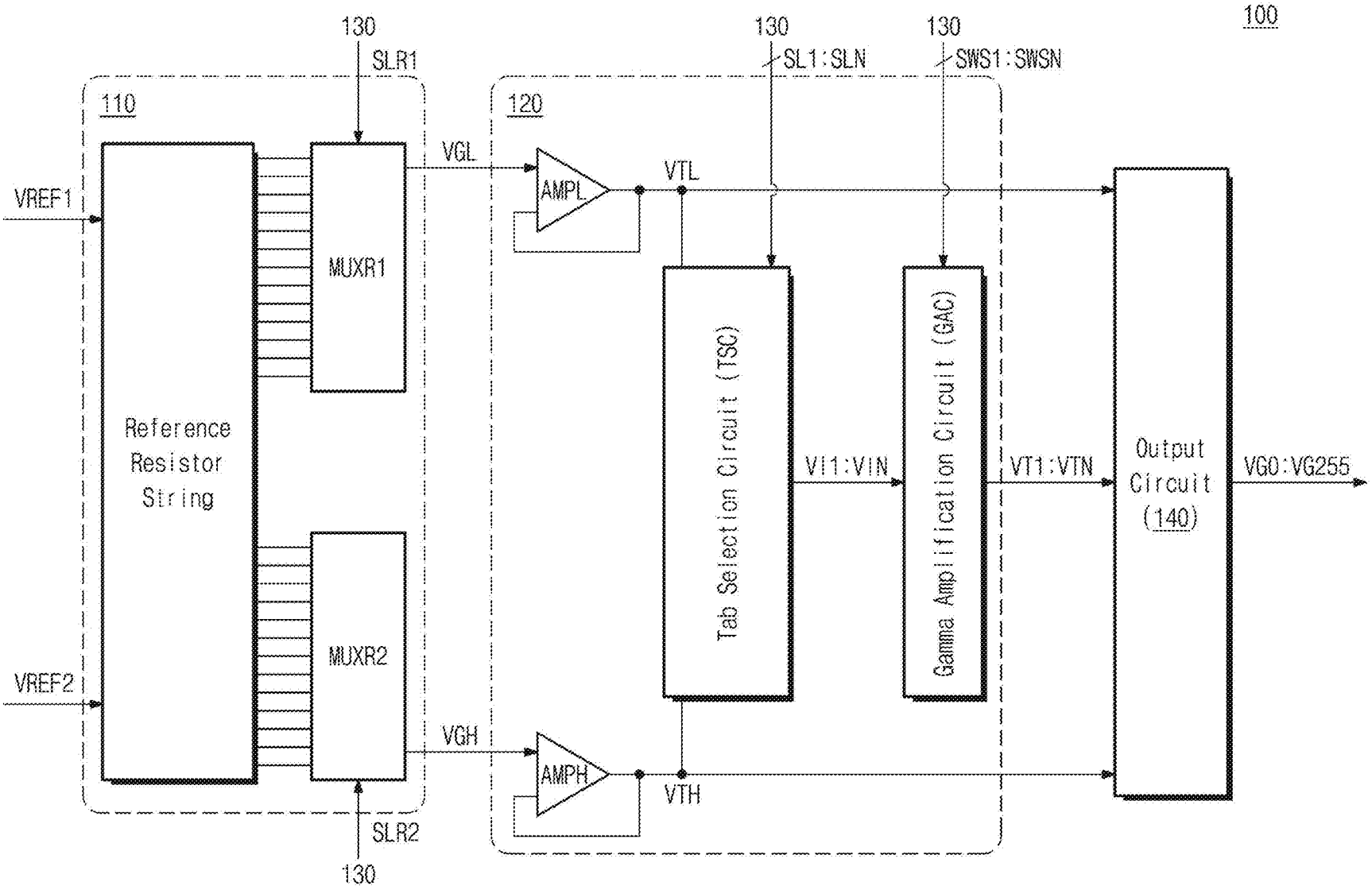
FIG. 3 is a block diagram illustrating a gamma voltage generator of FIG. 2 in detail, according to some embodiments of the present disclosure.

FIG. 3 is a block diagram illustrating a gamma voltage generator of FIG. 2 in detail, according to some embodiments of the present disclosure. Referring to FIGS. 2 and 3, the gamma voltage generator 100 may include the reference voltage circuit 110, the gamma tab circuit 120, the adjustment circuit 130, and the output circuit 140.

The reference voltage circuit 110 may receive the first reference voltage VREF1 and the second reference voltage VREF2. The reference voltage circuit 110 may receive a first reference selection signal SLR1 and a second reference selection signal SLR2 from the adjustment circuit 130. The reference voltage circuit 110 may include a reference resistor string, a first reference multiplexer MUXR1, and a second reference multiplexer MUXR2. The reference resistor string may include resistors that are connected in series between a node arranged for receiving the first reference voltage VREF1 and a node arranged for receiving the second reference voltage VREF2. The reference resistor string may provide a plurality of voltages between the first reference voltage VREF1 and the second reference voltage VREF2 through voltage division.

The first reference multiplexer MUXR1 may receive the first reference selection signal SLR1 from the adjustment circuit 130. The first reference multiplexer MUXR1 may select one of the first reference voltage VREF1, the second reference voltage VREF2, and the plurality of voltages between the first reference voltage VREF1 and the second reference voltage VREF2 depending on the first reference selection signal SLR1 and may determine the selected voltage as the lower reference gamma voltage VGL.

The second reference multiplexer MUXR2 may receive the second reference selection signal SLR2 from the adjustment circuit 130. The second reference multiplexer MUXR2 may select one of the first reference voltage VREF1, the second reference voltage VREF2, and the plurality of voltages between the first reference voltage VREF1 and the second reference voltage VREF2 depending on the second reference selection signal SLR2 and may determine the selected voltage as the upper reference gamma voltage VGH.

The gamma tab circuit 120 may receive the lower reference gamma voltage VGL and the upper reference gamma voltage VGH from the reference voltage circuit 110. The gamma tab circuit 120 may receive a plurality of selection signals SL1 to SLN and a plurality of switch set control signals SWS1 to SWSN from the adjustment circuit 130. The gamma tab circuit 120 may include a lower amplifier AMPL, an upper amplifier AMPH, a tab selection circuit TSC, and a gamma amplification circuit GAC. The lower amplifier AMPL may determine the minimum gamma tab voltage level VTL, based on the lower reference gamma voltage VGL. The upper amplifier AMPH may determine the maximum gamma tab voltage level VTH, based on the upper reference gamma voltage VGH.

The tab selection circuit TSC may be connected between a node having the minimum gamma tab voltage level VTL and a node having the maximum gamma tab voltage level VTH. The tab selection circuit TSC may receive the plurality of selection signals SL1 to SLN from the adjustment circuit 130. The tab selection circuit TSC may generate an input signal, based on the plurality of voltage levels between the minimum gamma tab voltage level VTL and the maximum gamma tab voltage level VTH. According to some embodiments of the present disclosure, the input signal may have a plurality of input voltage levels VI1 to VIN that are sequentially repeated.

The gamma amplification circuit GAC may receive the input signal from the tab selection circuit TSC. The gamma amplification circuit GAC may receive the plurality of switch set control signals SWS1 to SWSN from the adjustment circuit 130. The gamma amplification circuit GAC may generate a plurality of output signals having the plurality of gamma tab voltage levels VT1 to VTN respectively, based on the input signal and the plurality of switch set control signals SWS1 to SWSN. The plurality of gamma tab voltage levels VT1 to VTN may correspond to the plurality of input voltage levels VI1 to VIN, respectively.

The output circuit 140 may receive the minimum gamma tab voltage level VTL, the maximum gamma tab voltage level VTH, and the plurality of gamma tab voltage levels VT1 to VTN from the gamma tab circuit 120. The output circuit 140 may generate the plurality of gamma voltages VG0 to VG255 by dividing the minimum gamma tab voltage level VTL, the maximum gamma tab voltage level VTH, and the plurality of gamma tab voltage levels VT1 to VTN.

Figure 4:
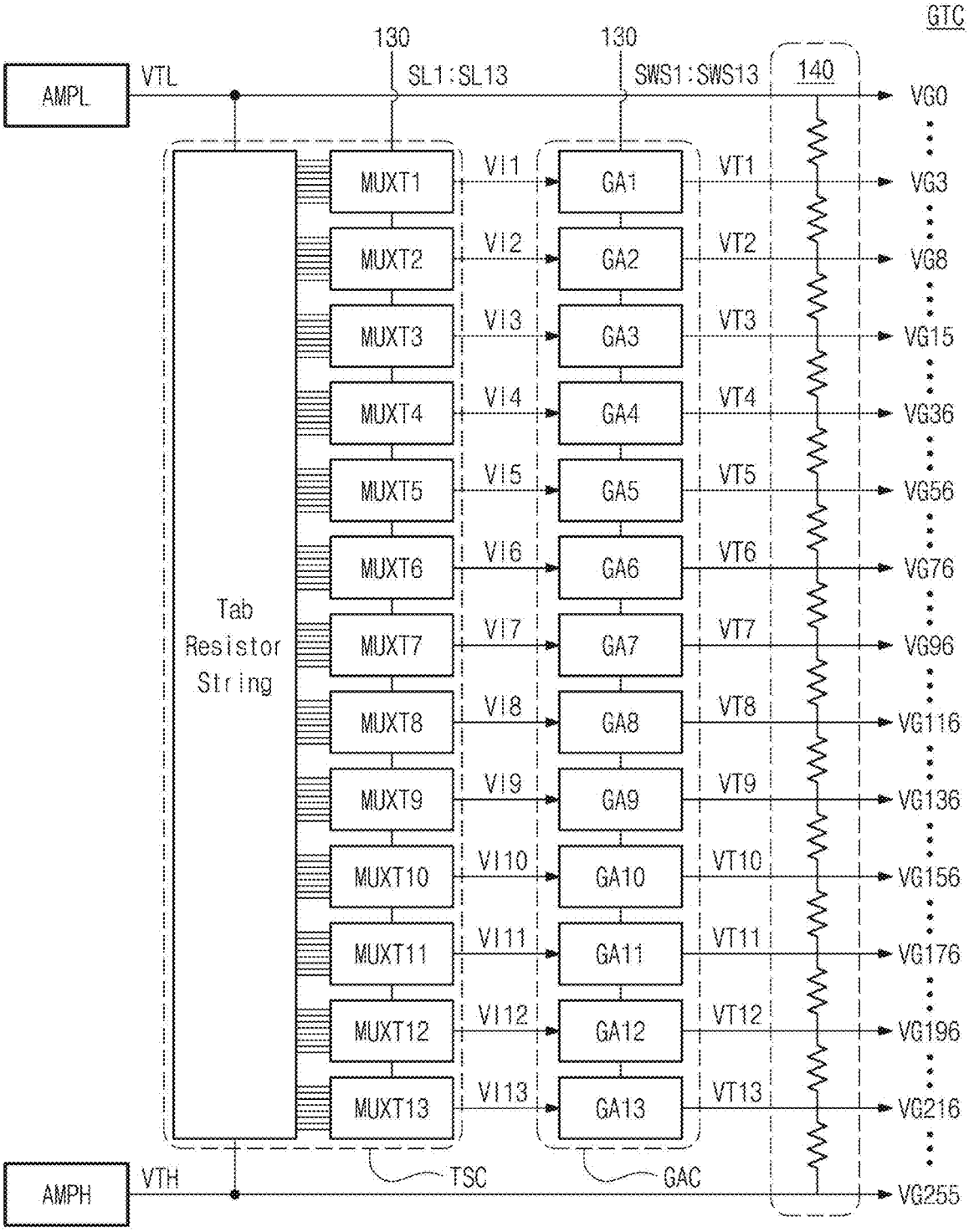
FIG. 4 is a diagram describing a general gamma tab circuit.

FIG. 4 is a diagram describing a general gamma tab circuit. A general gamma tab circuit GTC will be described with reference to FIG. 4. The general gamma tab circuit GTC may correspond to the gamma tab circuit 120 of FIG. 3. Below, the general gamma tab circuit GTC will be described for better understanding of embodiments of the present disclosure, and it is not intended to acknowledge the general gamma tab circuit (GTC) as the prior art or the known technology.

The general gamma tab circuit GTC may include a lower amplifier AMPL, an upper amplifier AMPH, a tab selection circuit TSC, and a gamma amplification circuit GAC. The tab selection circuit TSC may include a tab resistor string and a plurality of tab multiplexers. For example, the plurality of tab multiplexers may include first to thirteenth tab multiplexers MUXT1 to MUXT13, but the present disclosure is not limited thereto. For example, the number of tab multiplexers may increase or decrease.

The tab resistor string may be connected between a node having the minimum gamma tab voltage level VTL and a node having the maximum gamma tab voltage level VTH. The first to thirteenth tab multiplexers MUXT1 to MUXT13 may receive first to thirteenth selection signals SL1 to SL13 from the adjustment circuit 130, respectively. The first to thirteenth tab multiplexers MUXT1 to MUXT13 may determine (or select) voltage levels divided through the tab resistor string as the first to thirteenth input voltage levels VI1 to VI13 in response to the first to thirteenth selection signals SL1 to SL13, respectively. The first to thirteenth tab multiplexers MUXT1 to MUXT13 may generate input signals having corresponding voltage levels of the first to thirteenth input voltage levels VI1 to VI13, respectively.

The gamma amplification circuit GAC may include first to thirteenth gamma amplifiers GA1 to GA13. The first to thirteenth gamma amplifiers GA1 to GA13 may receive the first to thirteenth switch set control signals SWS1 to SWS13 from the adjustment circuit 130. The first to thirteenth gamma amplifiers GA1 to GA13 may correspond to the first to thirteenth tab multiplexers MUXT1 to MUXT13, respectively.

The first to thirteenth gamma amplifiers GA1 to GA13 may generate output signals having first to thirteenth gamma tab voltage levels VT1 to VT13, based on the first to thirteenth switch set control signals SWS1 to SWS13 and the input signals received from the first to thirteenth tab multiplexers MUXT1 to MUXT13.

For example, the first gamma amplifier GA1 may generate the output signal having the first gamma tab voltage level VT1, based on the first switch set control signal SWS1 and the input signal having the first input voltage level VI1. The second gamma amplifier GA2 may generate the output signal having the second gamma tab voltage level VT2 based on the second switch set control signal SWS2 and the input signal having the second input voltage level VI2.

The minimum gamma tab voltage level VTL, the first to thirteenth gamma tab voltage levels VT1 to VT13, and the maximum gamma tab voltage level VTH may be divided into the plurality of gamma voltages VG0 to VG255 through the output circuit 140.

Figure 5:
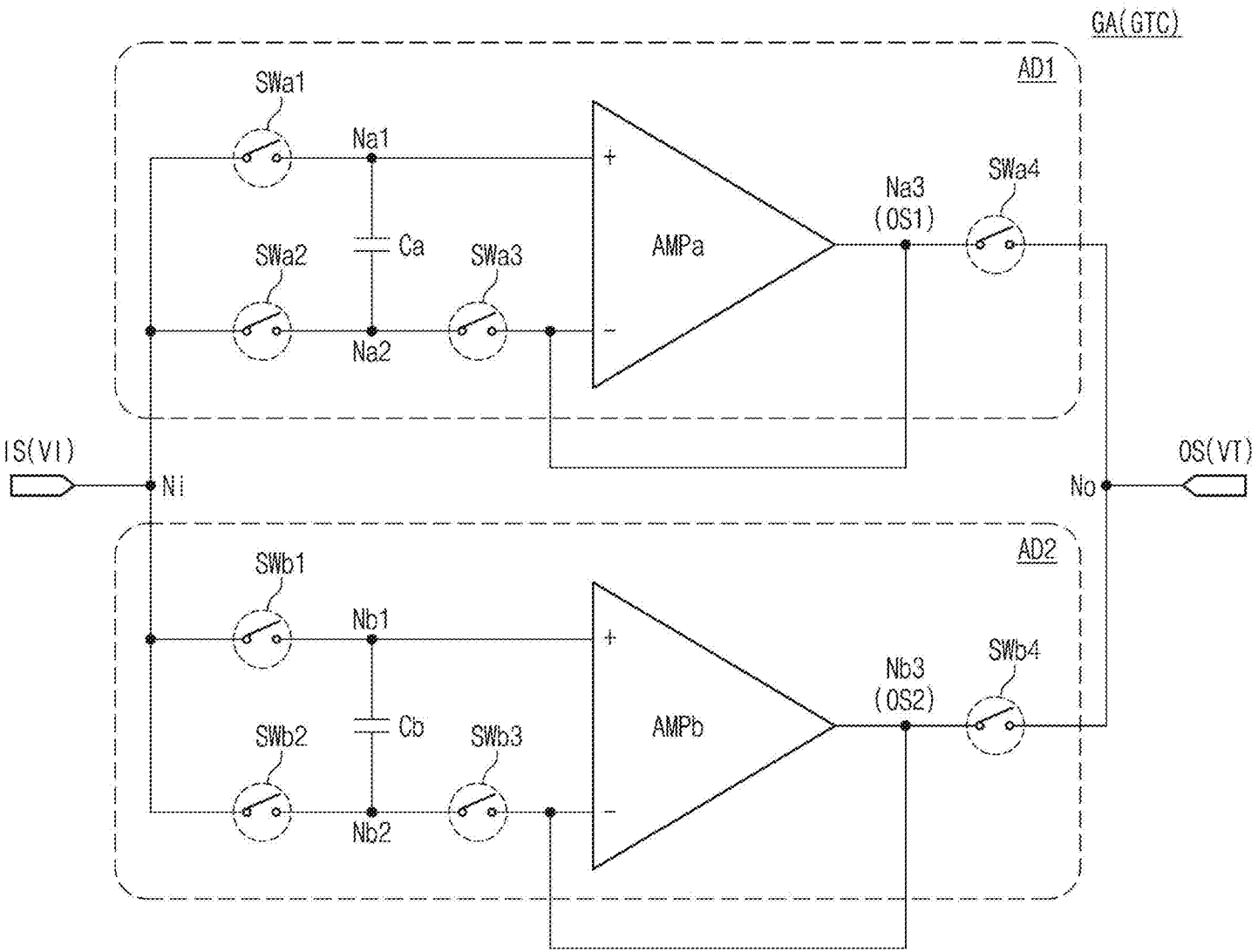
FIG. 5 is a circuit diagram illustrating a gamma amplifier of FIG. 4.

FIG. 5 is a circuit diagram illustrating a gamma amplifier of FIG. 4. A gamma amplifier GA of the general gamma tab circuit GTC will be described with reference to FIGS. 4 and 5. The gamma amplifier GA may correspond to one of the first to thirteenth gamma amplifiers GA1 to GA13 of FIG. 4. The gamma amplifier GA may generate an output signal OS having a gamma tab voltage level VT, based on an input signal IS having an input voltage level VI and a switch set control signal. The switch set control signal may include switch control signals for controlling whether to turn on or turn off switches SWa1 to SWa4 and SWb1 to SWb4. Processing circuitry (for example, the timing controller 11, the adjustment circuit 130, or including these elements and other processing and control circuitry) may be configured to generate the switch set control signal, control timing of when input signals are received and otherwise control the timing of operations, including switches being turned on or off for the gamma amplifiers.

The gamma amplifier GA may include a first amplification device AD1 and a second amplification device AD2. The first amplification device AD1 and the second amplification device AD2 may be connected in parallel between an input node Ni arranged for receiving the input signal IS and an output node No arranged for outputting the output signal OS. The first amplification device AD1 and the second amplification device AD2 may be symmetrical with respect to each other and may operate to be complementary.

The first amplification device AD1 may include the first switch SWa1, the second switch SWa2, the third switch SWa3, the fourth switch SWa4, a capacitor Ca, and an amplifier AMPa.

The first switch SWa1 may be connected between the input node Ni and a first node Na1. The second switch SWa2 may be connected between the input node Ni and a second node Na2. The capacitor Ca may be connected between the first node Na1 and the second node Na2. The third switch SWa3 may be connected between the second node Na2 and a third node Na3. The fourth switch SWa4 may be connected between the third node Na3 and the output node No.

The amplifier AMPa may include a non-inverting input terminal connected with the first node Na1, an inverting input terminal connected with the third node Na3, and an output terminal connected with the third node Na3. The amplifier AMPa may generate a first output signal OS1 having the gamma tab voltage level VT at the output terminal, based on a voltage level of the non-inverting input terminal and a voltage level of the inverting input terminal.

As in the above description, the second amplification device AD2 may include the first switch SWb1, the second switch SWb2, the third switch SWb3, the fourth switch SWb4, a capacitor Cb, and an amplifier AMPb.

The first switch SWb1 may be connected between the input node Ni and a first node Nb1. The second switch SWb2 may be connected between the input node Ni and a second node Nb2. The capacitor Cb may be connected between the first node Nb1 and the second node Nb2. The third switch SWb3 may be connected between the second node Nb2 and a third node Nb3. The fourth switch SWb4 may be connected between the third node Nb3 and the output node No.

The amplifier AMPb may include a non-inverting input terminal connected with the first node Nb1, an inverting input terminal connected with the third node Nb3, and an output terminal connected with the third node Nb3. The amplifier AMPb may generate a second output signal OS2 having the gamma tab voltage level VT at the output terminal, based on a voltage level of the non-inverting input terminal and a voltage level of the inverting input terminal.

The output signal OS of the gamma amplifier GA may include the first output signal OS1 and the second output signal OS2 that are complementarily provided to the output node No. Because the first output signal OS1 and the second output signal OS2 have the same gamma tab voltage level VT, the output signal OS may maintain the gamma tab voltage level VT in all time periods.

In some embodiments, the gamma amplifier GA may compensate for an offset voltage by using a capacitor. The offset voltage may mean an error between an input terminal and an output terminal of an amplifier. For example, during a first time period, the first amplification device AD1 of the gamma amplifier GA may accumulate a voltage corresponding to a difference between the input voltage level VI and an offset voltage level of the amplifier AMPa through the capacitor Ca. During a second time period, the first amplification device AD1 of the gamma amplifier GA may generate the first output signal OS1 in which the offset voltage of the amplifier AMPa is compensated for, by amplifying a voltage lower than the input voltage level VI of the input signal IS as much as an accumulated voltage of the capacitor Ca.

As in the above description, the second amplification device AD2 of the gamma amplifier GA may generate the second output signal OS2 in which the offset voltage of the amplifier AMPb is compensated for. An image quality of a display device including the gamma amplifier GA may be improved by compensating for an offset voltage. An operation of a gamma amplifier will be described in detail with reference to FIG. 6.

Figure 6:
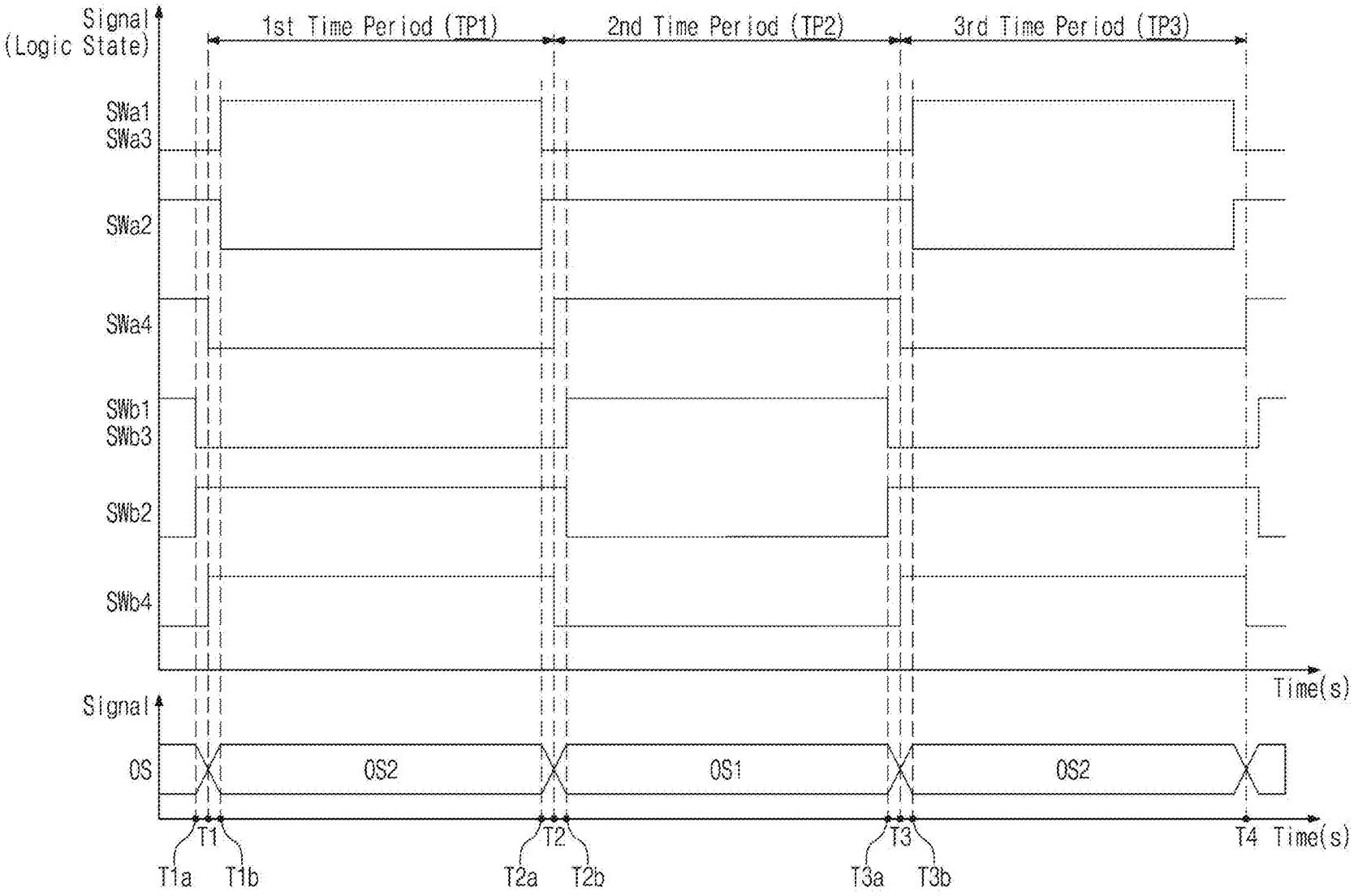
FIG. 6 is a graph describing a control signal and an output signal of a gamma amplifier of FIG. 5.

FIG. 6 is a graph describing a control signal and an output signal of a gamma amplifier of FIG. 5. Referring to FIGS. 5 and 6, FIG. 6 describes waveforms of switch control signals of the switches SWa1 to SWa4 and SWb1 to SWb4 of the gamma amplifier GA and the output signal OS. In FIG. 6, a horizontal axis represents a time, and a vertical axis represents information of a signal.

A switch control signal may have a first logic state or a second logic state. For example, the first logic state may indicate a logical high level, and a second logic state may indicate a logical low level. A switch may be turned on in response to the switch control signal of the first logic state and may be turned off in response to the switch control signal of the second logic state.

The fourth switch SWa4 of the first amplification device AD1 and the fourth switch SWb4 of the second amplification device AD2 may operate to be complementary. For example, at a first time point T1, the fourth switch SWa4 may be turned off, and the fourth switch SWb4 may be turned on. At a second time point T2, the fourth switch SWa4 may be turned on, and the fourth switch SWb4 may be turned off. At a third time point T3, the fourth switch SWa4 may be turned off, and the fourth switch SWb4 may be turned on. At a fourth time point T4, the fourth switch SWa4 may be turned on, and the fourth switch SWb4 may be turned off.

A first time period TP1 may be a time period from the first time point T1 to the second time point T2. In the first time period TP1, the second amplification device AD2 may output the second output signal OS2. In detail, in the first time period TP1, the fourth switch SWb4 may be maintained in a turn-on state. For a stable operation of the fourth switch SWb4, the first and third switches SWb1 and SWb3 may be turned off before the first time period TP1 (e.g., at a time point T1*a*) and may be turned on after the first time period TP1 (e.g., at a time point T2*b*). The second switch SWb2 may operate to be complementary to the first and third switches SWb1 and SWb3.

In the first time period TP1, the first amplification device AD1 may accumulate a voltage corresponding to a difference between the input voltage level VI of the input signal IS and an offset voltage level of the amplifier AMPa in the capacitor Ca. The fourth switch SWa4 may be maintained in a turn-off state. In a next output operation (e.g., a third time period TP3), the voltage accumulated in the capacitor Ca may be used to decrease the input voltage level of the input signal IS to be provided to the input terminal of the amplifier AMPa such that the output signal OS2 in which an offset voltage is compensated for is generated.

A second time period TP2 may be a time period from the second time point T2 to the third time point T3. In the second time period TP2, the first amplification device AD1 may output the first output signal OS1. In detail, in the second time period TP2, the fourth switch SWa4 may be maintained in a turn-on state. For a stable operation of the fourth switch SWa4, the first and third switches SWa1 and SWa3 may be turned off before the second time period TP2 (e.g., at a time point T2*a*) and may be turned on after the second time period TP2 (e.g., at a time point T3*b*). The second switch SWa2 may operate to be complementary to the first and third switches SWa1 and SWa3.

In the second time period TP2, the second amplification device AD2 may accumulate a voltage corresponding to a difference between the input voltage level VI of the input signal IS and an offset voltage level of the amplifier AMPb in the capacitor Cb. The fourth switch SWb4 may be maintained in a turn-off state.

A third time period TP3 may be a time period from the third time point T3 to the fourth time point T4. Operations in the third time period TP3 may be similar to the operations in the first time period TP1. For example, the operations in the first time period TP1 and the operations in the second time period TP2 may be sequentially repeated.

As described above, the general gamma tab circuit GTC compensating for an offset voltage is described with reference to FIGS. 4 to 6. However, as illustrated in FIG. 4, because each of a plurality of gamma amplifiers receives an input signal from the corresponding tab multiplexer, tab multiplexers, the number of which is equal to the number of gamma amplifiers, may be required. As such, a chip size of the gamma tab circuit GTC and a chip size of a gamma voltage generator including the same may increase.

Figure 7:
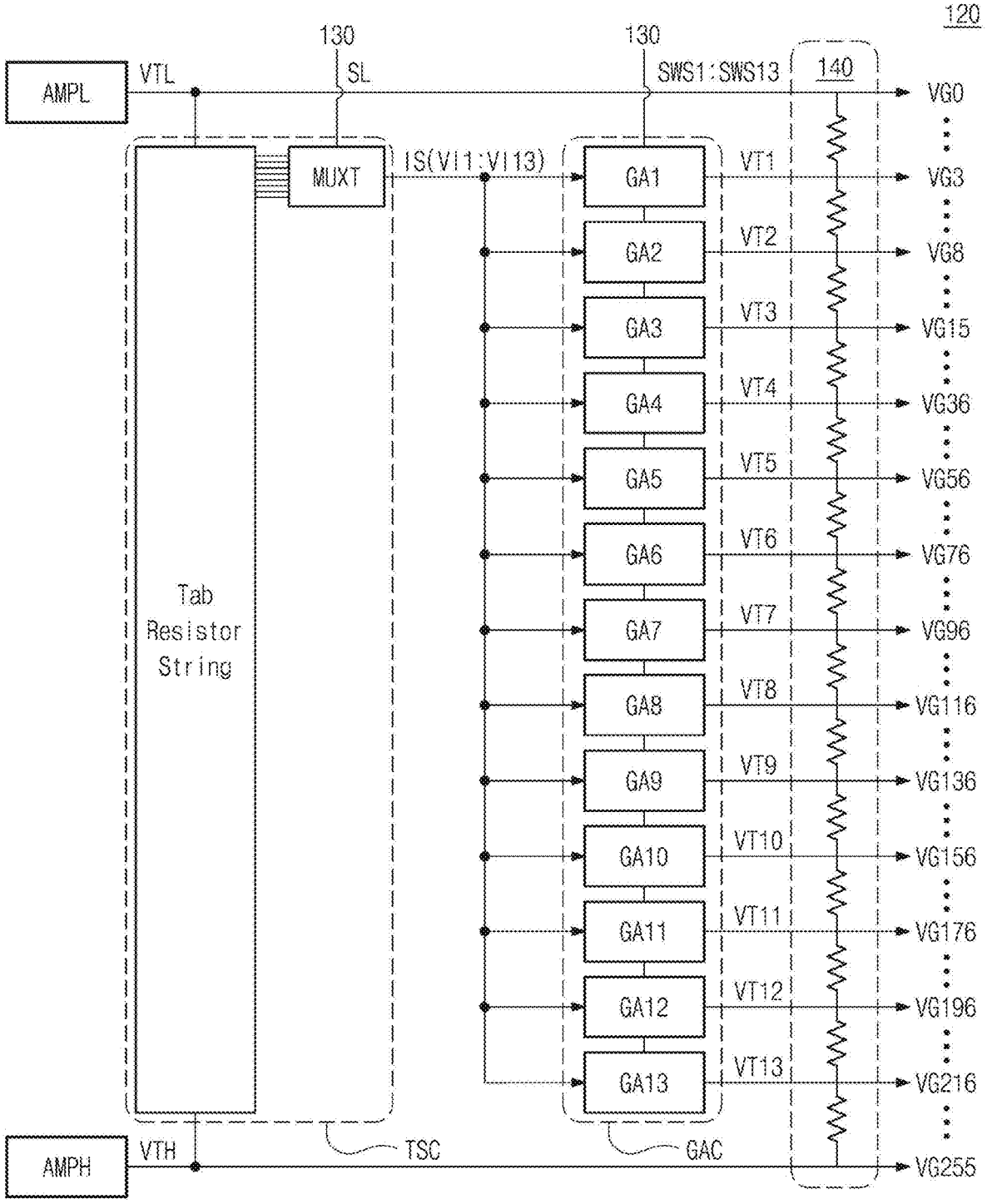
FIG. 7 is a diagram describing a gamma tab circuit of FIG. 3 according to some embodiments of the present disclosure.

FIG. 7 is a diagram describing a gamma tab circuit of FIG. 3 according to some embodiments of the present disclosure. The gamma tab circuit 120 according to some embodiments of the present disclosure will be described with reference to FIGS. 3 and 7.

The gamma tab circuit 120 may include the lower amplifier AMPL, the upper amplifier AMPH, the tab selection circuit TSC, and the gamma amplification circuit GAC. The tab selection circuit TSC may include the tab resistor string and a tab multiplexer MUXT. Unlike the tab selection circuit TSC of FIG. 4 including tab multiplexers, the number of which is equal to the number of gamma amplifiers of the gamma amplification circuit GAC, the tab selection circuit TSC of FIG. 7 may include one tab multiplexer MUXT.

The tab resistor string may be connected between the node having the minimum gamma tab voltage level VTL and the node having the maximum gamma tab voltage level VTH. The tab multiplexer MUXT may receive a selection signal SL from the adjustment circuit 130. Depending on the selection signal SL, the tab multiplexer MUXT may determine (or select) a plurality of input voltage levels of voltage levels divided by the tab resistor string and may generate the input signal IS. For example, the tab multiplexer MUXT may determine first to thirteenth input voltage levels VI1 to VI13 of the voltage levels divided by the tab resistor string depending on the selection signal SL and may generate the input signal IS in which the first to thirteenth input voltage levels VI1 to VI13 are sequentially repeated over time.

For better understanding of the present disclosure, the description will be given as the tab multiplexer MUXT generates the input signal IS having the first to thirteenth input voltage levels VI1 to VI13, but the present disclosure is not limited thereto. For example, the number of input voltage levels that are sequentially repeated in the input signal IS of the tab multiplexer MUXT may increase or decrease.

The gamma amplification circuit GAC may include the first to thirteenth gamma amplifiers GA1 to GA13. The first to thirteenth gamma amplifiers GA1 to GA13 may receive the first to thirteenth switch set control signals SWS1 to SWS13 from the adjustment circuit 130, respectively. The first to thirteenth gamma amplifiers GA1 to GA13 may receive the input signal IS from the tab selection circuit TSC. In other words, the first to thirteenth gamma amplifiers GA1 to GA13 may share the tab multiplexer MUXT and may operate based on the same input signal IS.

The first to thirteenth gamma amplifiers GA1 to GA13 may respectively generate output signals having the first to thirteenth gamma tab voltage levels VT1 to VT13, based on the first to thirteenth switch set control signals SWS1 to SWS13 and the input signal received from the tab multiplexer MUXT.

For example, the input signal IS may have the first input voltage level VI1 in a first time period and may have the second input voltage level VI2 in a second time period. The first gamma amplifier GA1 may generate the output signal having the first gamma tab voltage level VT1, based on the input signal IS in the first time period and the first switch set control signal SWS1. The second gamma amplifier GA2 may generate the output signal having the second gamma tab voltage level VT2, based on the input signal IS in the second time period and the second switch set control signal SWS2.

The minimum gamma tab voltage level VTL, the first to thirteenth gamma tab voltage levels VT1 to VT13, and the maximum gamma tab voltage level VTH may be divided into the plurality of gamma voltages VG0 to VG255 through the output circuit 140.

Figure 8:
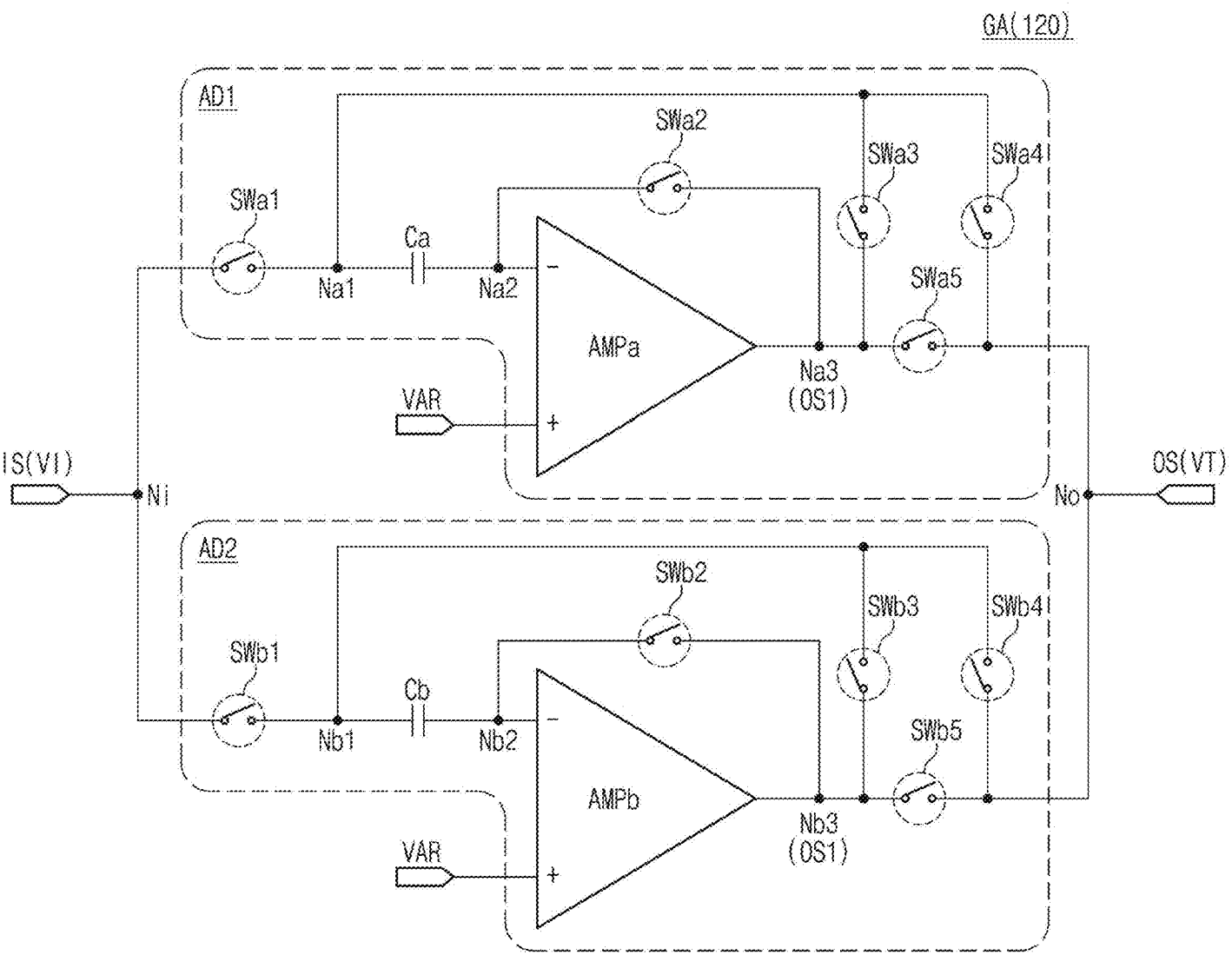
FIG. 8 is a circuit diagram illustrating a gamma amplifier of FIG. 7 in detail, according to some embodiments of the present disclosure.

FIG. 8 is a circuit diagram illustrating a gamma amplifier of FIG. 7 in detail, according to some embodiments of the present disclosure. A circuit diagram of the gamma amplifier GA in the gamma tab circuit 120 according to some embodiments of the present disclosure will be described with reference to FIGS. 7 and 8. The gamma amplifier GA may correspond to one of the first to thirteenth gamma amplifiers GA1 to GA13 of FIG. 7. The gamma amplifier GA may generate the output signal OS having the gamma tab voltage level VT, based on the input signal IS having the input voltage level VI and a switch set control signal during a specific time period. The switch set control signal may include switch control signals for controlling whether to turn on or turn off switches SWa1 to SWa5 and SWb1 to SWb5. The gamma amplifier GA may receive an amplification reference voltage VAR from the external device or the voltage regulator. The amplification reference voltage VAR may refer to a voltage for an amplification operation of the amplifiers AMPa and AMPb.

The gamma amplifier GA may include the first amplification device AD1 and the second amplification device AD2. The first amplification device AD1 and the second amplification device AD2 may be connected in parallel between the input node Ni arranged for receiving the input signal IS and the output node No arranged for outputting the output signal OS. The first amplification device AD1 and the second amplification device AD2 may be symmetrical with respect to each other and may operate to be complementary. The output signal OS may include the first output signal OS1 and the second output signal OS2 that are provided to be complementary and may maintain the gamma tab voltage level VT in all time periods.

In some embodiments, the first amplification device AD1 and the second amplification device AD2 may receive the input signal IS only during a time period in which the input signal IS has the input voltage level VI corresponding to the gamma amplifier GA. For example, the input signal IS may have another input voltage level corresponding to another gamma amplifier in an arbitrary time period. In this case, all the switches SWa1 and SWb1 may be turned off. The first amplification device AD1 or the second amplification device AD2 may generate the first output signal OS1 or the second output signal OS2, based on a voltage accumulated in the capacitor Ca or the capacitor Cb.

The first amplification device AD1 may include the first switch SWa1, the second switch SWa2, the third switch SWa3, the fourth switch SWa4, the fifth switch SWa5, the capacitor Ca, and the amplifier AMPa.

The first switch SWa1 may be connected between the input node Ni and the first node Na1. The capacitor Ca may be connected between the first node Na1 and the second node Na2. The second switch SWa2 may be connected between the second node Na2 and the third node Na3. The third switch SWa3 may be connected between the first node Na1 and the third node Na3. The fourth switch SWa4 may be connected between the first node Na1 and the output node No. The fifth switch SWa5 may be connected between the third node Na3 and the output node No.

The amplifier AMPa may include a first input terminal (e.g., an inverting input terminal) connected with the second node Na2, a second input terminal (e.g., a non-inverting input terminal) arranged for receiving the amplification reference voltage VAR, and an output terminal connected with the third node Na3. The amplifier AMPa may generate the first output signal OS1 having the gamma tab voltage level VT at the output terminal, based on a voltage level of the first input terminal and a voltage level of the second input terminal.

The second amplification device AD2 may include the first switch SWb1, the second switch SWb2, the third switch SWb3, the fourth switch SWb4, the fifth switch SWb5, the capacitor Cb, and the amplifier AMPb.

The first switch SWb1 may be connected between the input node Ni and the first node Nb1. The capacitor Cb may be connected between the first node Nb1 and the second node Nb2. The second switch SWb2 may be connected between the second node Nb2 and the third node Nb3. The third switch SWb3 may be connected between the first node Nb1 and the third node Nb3. The fourth switch SWb4 may be connected between the first node Nb1 and the output node No. The fifth switch SWb5 may be connected between the third node Nb3 and the output node No.

The amplifier AMPb may include a first input terminal (e.g., an inverting input terminal) connected with the second node Nb2, a second input terminal (e.g., a non-inverting input terminal) arranged for receiving the amplification reference voltage VAR, and an output terminal connected with the third node Nb3. The amplifier AMPb may generate the second output signal OS2 having the gamma tab voltage level VT at the output terminal, based on a voltage level of the first input terminal and a voltage level of the second input terminal.

In some embodiments, the gamma amplifier GA may compensate for an offset voltage by using a capacitor. An image quality of a display device including the gamma amplifier GA may be improved by compensating for an offset voltage.

In some embodiments, even though the supply of the input signal IS is blocked, the gamma amplifier GA may generate the output signal OS, based on a voltage accumulated in a capacitor. As such, the gamma amplifier GA may share the input signal IS, the input voltage level of which varies over time, with another gamma amplifier (i.e., may share the tab multiplexer MUXT of the tab selection circuit TSC). In other words, a chip size of the gamma tab circuit GTC and a chip size of the gamma voltage generator 100 including the same may decrease.

Figure 9A:
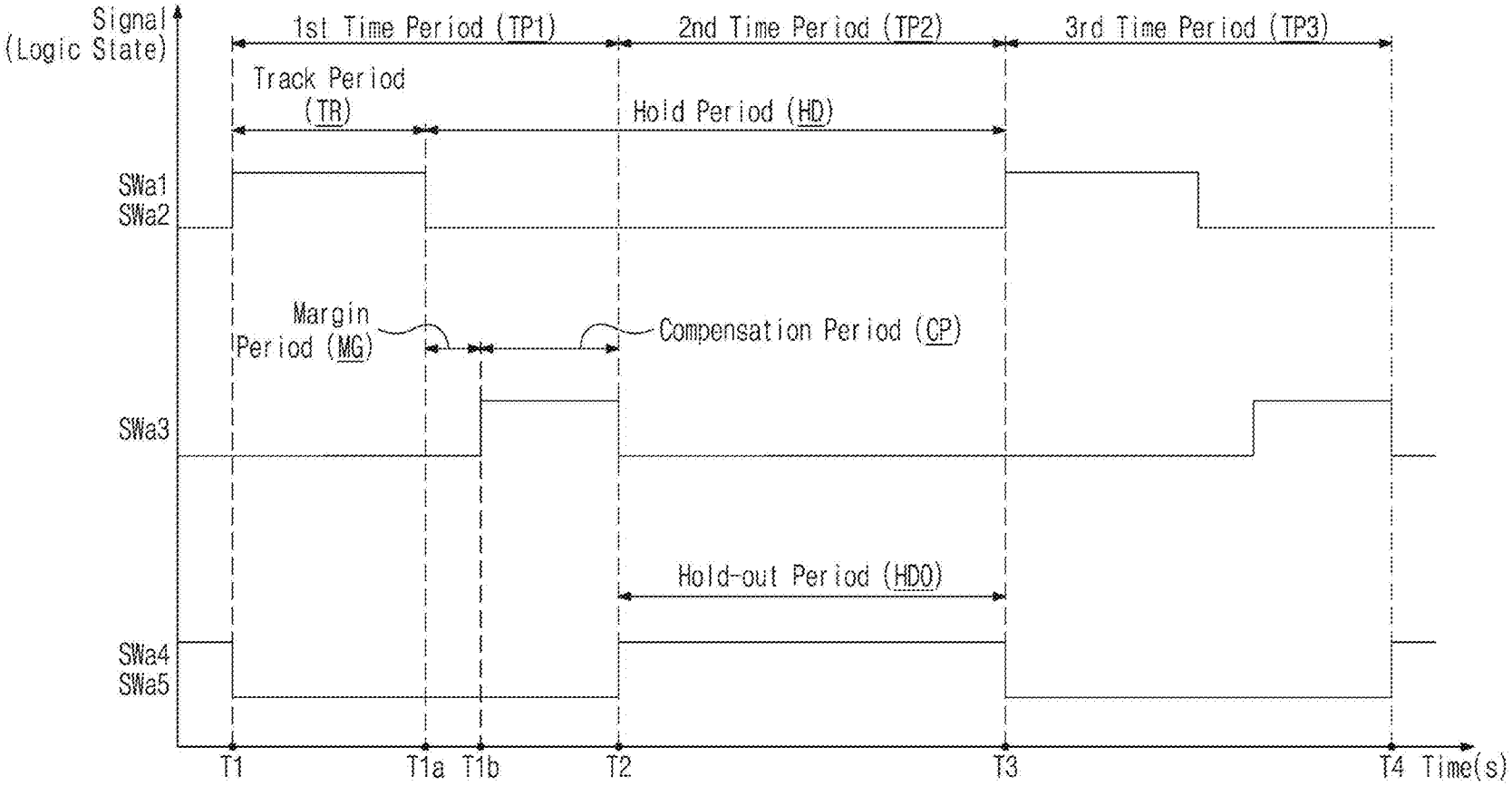
FIGS. 9A and 9B are graphs describing a control signal and an output signal of a gamma amplifier of FIG. 8 according to some embodiments of the present disclosure.
Figure 9B:
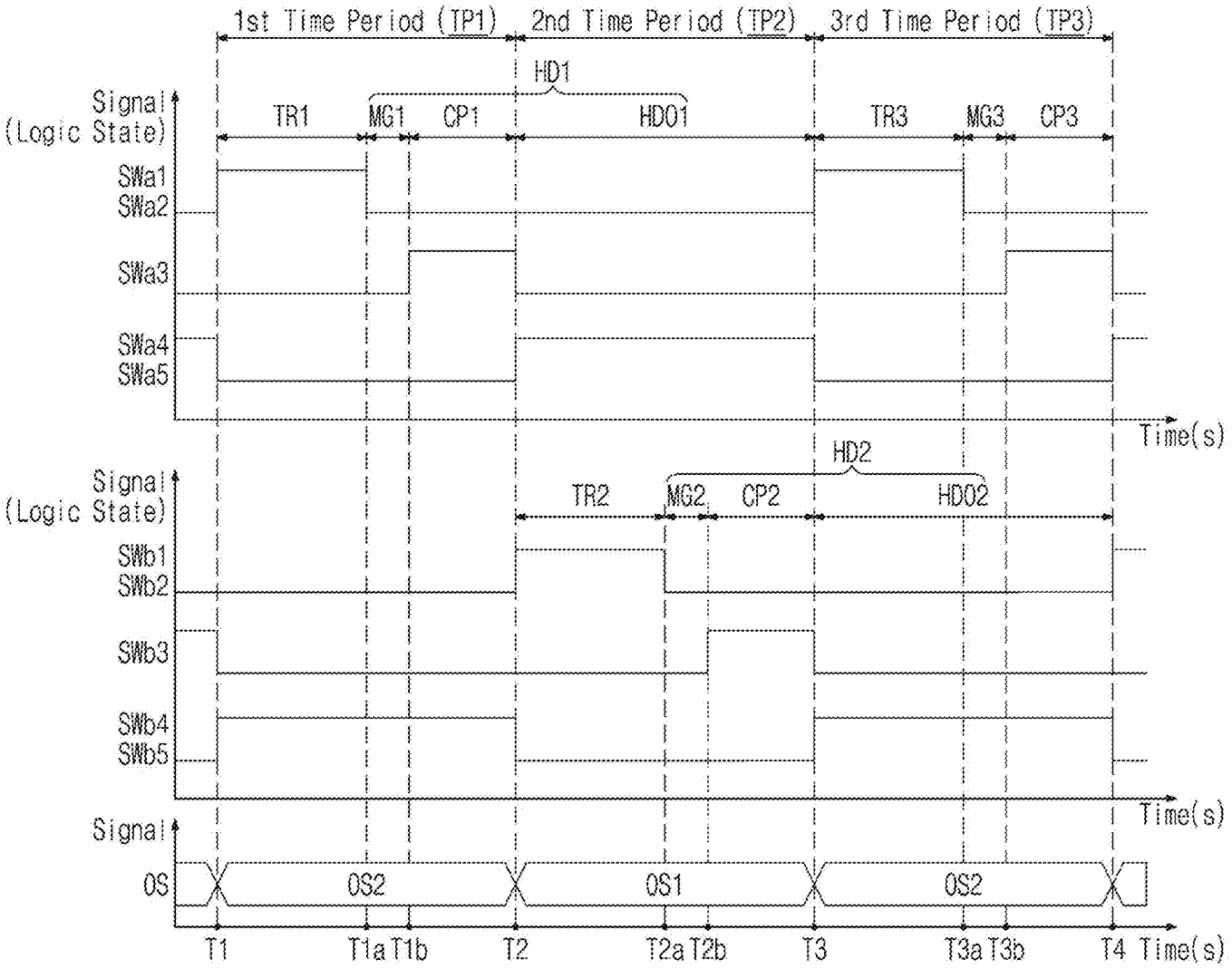

FIGS. 9A and 9B are graphs describing a control signal and an output signal of a gamma amplifier of FIG. 8 according to some embodiments of the present disclosure. Switch control signals of the switches SWa1 to SWa5 of the first amplification device AD1 in the gamma amplifier GA of FIG. 8 will be described with reference to FIG. 9A. In FIG. 9A, a horizontal axis represents a time, and a vertical axis represents information of a signal.

Referring to FIGS. 8 and 9A, the first amplification device AD1 of the gamma amplifier GA may operate in a track-and-hold manner A track operation may refer to an operation arranged for receiving the input signal IS and accumulating a voltage corresponding to a difference between the input voltage level VI and an offset voltage level in a capacitor. A hold operation may refer to an operation of compensating for an offset voltage based on the accumulated voltage and providing the output signal OS to the output node No.

A first time period TP1 may be a time period from a first time point T1 to a second time point T2. The first time period TP1 may include a track period TR and a compensation period CP. In some embodiments, the first time period TP1 may further include a margin period MG between the track period TR and the compensation period CP. The track period TR may be a time point from the first time point T1 to a time point T1*a*. The margin period MG may be a time period from the time point T1*a* to a time point T1*b*. The compensation period CP may be a time period from the time point T1*b* to the second time point T2.

The track period TR may refer to a period in which the first amplification device AD1 performs the track operation on the input signal IS. In the track period TR, the first and second switches SWa1 and SWa2 of the first amplification device AD1 may be turned on, and the third, fourth, and fifth switches SWa3, SWa4, and SWa5 of the first amplification device AD1 may be turned off.

The margin period MG may be a period that is added between the track operation and the operation of compensating for an offset voltage for a stable operation of the first amplification device AD1. For example, a voltage difference of the first node Na1 and the second node Na2 may be different from a voltage difference between the first node Na1 and the third node Na3. The margin period MG may be added to prevent an over-current or an abnormal operation of a circuit due to a sharp voltage change. In the margin period MG, all the first to fifth switches SWa1 to SWa5 of the first amplification device AD1 may be turned off.

The compensation period CP may refer to a period in which the first amplification device AD1 compensates for an offset voltage of the amplifier AMPa. In the compensation period CP, the first, second, fourth, and fifth switches SWa1, SWa2, SWa4, and SWa5 of the first amplification device AD1 may be turned off, and the third switch SWa3 of the first amplification device AD1 may be turned on.

A second time period TP2 may be a time period after the first time period TP1. For example, the second time period TP2 may be a time period from the second time point T2 to a third time point T3. The second time period TP2 may include a hold-out period HDO.

The hold-out period HDO may be a period in which the first output signal OS1 is provided to the output node No, based on a voltage that the first amplification device AD1 accumulates in the capacitor Ca. In the hold-out period HDO, the first, second, and third switches SWa1, SWa2, and SWa3 of the first amplification device AD1 may be turned off, and the fourth and fifth switches SWa4 and SWa5 of the first amplification device AD1 may be turned on.

In some embodiments, the margin period MG, the compensation period CP, and the hold-out period HDO may be collectively referred to as a "hold period HD". The hold period HD may be a period in which the supply of the input signal IS is blocked. For example, the hold period HD may be a period in which the first switch SWa1 of the first amplification device AD1 is turned off.

A third time period TP3 may be a time period from the third time point T3 to a fourth time point T4. Operations in the third time period TP3 may be similar to the operations in the first time period TP1. For example, the operations in the first time period TP1 and the operations in the second time period TP2 may be sequentially repeated.

FIG. 9B describes switch control signals of the switches SWa1 to SWa5 of the first amplification device AD1 of the gamma amplifier GA, switch control signals of the switches SWb1 to SWb5 of the second amplification device AD2 of the gamma amplifier GA, and the output signal OS. In FIG. 9B, a horizontal axis represents a time, and a vertical axis represents information of a signal.

Referring to FIGS. 8 and 9B, both the first amplification device AD1 and the second amplification device AD2 of the gamma amplifier GA may operate in the track-and-hold manner The first amplification device AD1 and the second amplification device AD2 may operate to be complementary. In detail, the first amplification device AD1 may receive the input signal IS only during a first track period TR1, and the second amplification device AD2 may receive the input signal IS only during a second track period TR2. While the first amplification device AD1 provides the first output signal OS1 to the output node No, the second amplification device AD2 may not provide the second output signal OS2 to the output node No. In contrast, while the second amplification device AD2 provides the second output signal OS2 to the output node No, the first amplification device AD1 may not provide the first output signal OS1 to the output node No.

The first time period TP1 may be a time period from the first time point T1 to the second time point T2. The first time period TP1 may include the first track period TR1, a first margin period MG1, and a first compensation period CP1. The first track period TR1 may be a time point from the first time point T1 to the time point T1*a*. The first margin period MG1 may be a time point from the time point T1*a* to the time point T1*b*. The first compensation period CP1 may be a time period from the time point T1*b* to the second time point T2.

In the first time period TP1, the first and second switches SWa1 and SWa2 of the first amplification device AD1 may be turned on during the first track period TR1, all the first to fifth switches SWa1 to SWa5 of the first amplification device AD1 may be turned off during the first margin period MG1, and the third switch SWa3 of the first amplification device AD1 may be turned on during the first compensation period CP1.

In the first time period TP1, the second amplification device AD2 may output the second output signal OS2 to the output node No. The second output signal OS2 may be a signal in which an offset voltage of the input signal IS tracked in a previous time period of the first time period TP1 is compensated for.

The second time period TP2 may be a time period from the second time point T2 to the third time point T3. The second time period TP2 may include a first hold-out period HDO1. The first hold-out period HDO1 may be a time period from the second time point T2 to the third time point T3. The first margin period MG1, the first compensation period CP1, and the first hold-out period HDO1 may be collectively referred to as a "first hold period HD1".

In the second time period TP2, the fourth and fifth switches SWa4 and SWa5 of the first amplification device AD1 may be turned on during the first hold-out period HDO1. In other words, the fourth and fifth switches SWa4 and SWa5 of the first amplification device AD1 may be turned on during the whole second time period TP2.

The second time period TP2 may include the second track period TR2, a second margin period MG2, and a second compensation period CP2. The second track period TR2 may be a time point from the second time point T2 to a time point T2*a* . The second margin period MG2 may be a time point from the time point T2*a* to a time point T2*b* . The second compensation period CP2 may be a time period from the time point T2*b* to the third time point T3.

In the second time period TP2, the first and second switches SWb1 and SWb2 of the second amplification device AD2 may be turned on during the second track period TR2, all the first to fifth switches SWb1 to SWb5 of the second amplification device AD2 may be turned off during the second margin period MG2, and the third switch SWb3 of the second amplification device AD2 may be turned on during the second compensation period CP2.

The third time period TP3 may be a time period from the third time point T3 to the fourth time point T4. Operations of the first and second amplification devices AD1 and AD2 in the third time period TP3 may be similar to the operations of the first and second amplification devices AD1 and AD2 in the first time period TP1.

The third time period TP3 may include a third track period TR3, a third margin period MG3, and a third compensation period CP3. The third track period TR3 may be a time point from the third time point T3 to a time point T3*a* . The third margin period MG3 may be a time point from the time point T3*a* to a time point T3*b* . The third compensation period CP3 may be a time period from the time point T3*b* to the fourth time point T4.

In the third time period TP3, the first and second switches SWa1 and SWa2 of the first amplification device AD1 may be turned on during the third track period TR3, all the first to fifth switches SWa1 to SWa5 of the first amplification device AD1 may be turned off during the third margin period MG3, and the third switch SWa3 of the first amplification device AD1 may be turned on during the third compensation period CP3.

The third time period TP3 may include a second hold-out period HDO2. The second hold-out period HDO2 may be a time period from the third time point T3 to the fourth time point T4. The second margin period MG2, the second compensation period CP2, and the second hold-out period HDO2 may be collectively referred to as a "second hold period HD2".

In the third time period TP3, the fourth and fifth switches SWb4 and SWb5 of the second amplification device AD2 may be turned on during the second hold-out period HDO2. In other words, the fourth and fifth switches SWb4 and SWb5 of the second amplification device AD2 may be turned on during the whole third time period TP3.

The gamma amplifier GA that includes the first and second amplification devices AD1 and AD2 operating in the track-and-hold manner is described with reference to FIGS. 7, 8, 9A, and 9B. An image quality of a display device may be improved as the gamma amplifier GA compensates for an offset voltage by using a capacitor. Also, because a plurality of gamma amplifiers share the input signal IS, the input voltage level of which varies sequentially over time, a size of the tab selection circuit TSC and a size of a chip including the tab selection circuit TSC may be reduced compared to the case (e.g., FIG. 4) of using a plurality of tab multiplexers respectively corresponding to the plurality of gamma amplifiers.

FIG. 10 is a table describing a characteristic of an output signal of a gamma amplification circuit according to some embodiments of the present disclosure. A characteristic of an output signal of a gamma amplifier in a gamma amplification circuit will be described with reference to FIG. 10. The output signal of the gamma amplifier may be repeatedly measured through simulation, and voltage levels of the output signals repeatedly measured may have a deviation.

A simulation condition may change depending on whether an offset compensation function is applied to the gamma amplification circuit. For example, the gamma amplification circuit having the offset compensation function may correspond to the gamma amplification circuit GAC of FIGS. 3 and 7. Measurement values of the gamma amplification circuit having the offset compensation function may be obtained by repeatedly measuring the first gamma tab voltage level VT1 from the first gamma amplifier GA1 of the gamma amplification circuit GAC of FIG. 7. For example, a gamma amplification circuit that does not have the offset compensation function may correspond to a gamma amplification circuit that does not include a capacitor for accumulating an offset voltage.

In the case of the simulation associated with the gamma amplification circuit to which the offset compensation function is applied, an average of experimentally measured voltage levels may be "3.9998 V". A standard deviation of the experimentally measured voltage levels may be "$2.6291'10^{-4}$ V". A minimum value of the experimentally measured voltage levels may be "3.9990 V". A maximum value of the experimentally measured voltage levels may be "4.0007 V".

In the case of the simulation associated with the gamma amplification circuit to which the offset compensation function is not applied, an average of experimentally measured voltage levels may be "4.0000 V". A standard deviation of the experimentally measured voltage levels may be "$1.1504*10^{-3}$ V". A minimum value of the experimentally measured voltage levels may be "3.9966 V". A maximum value of the experimentally measured voltage levels may be "4.0033 V".

As described above, the gamma amplification circuit according to some embodiments of the present disclosure may have the offset compensation function. The gamma amplification circuit according to some embodiments of the present disclosure may generate an output signal having a gamma tab voltage level of a small standard deviation, compared to the gamma amplification circuit that does not have the offset compensation function. An image quality of a display device may be improved by providing a stable and uniform gamma tab voltage level.

Figure 11:
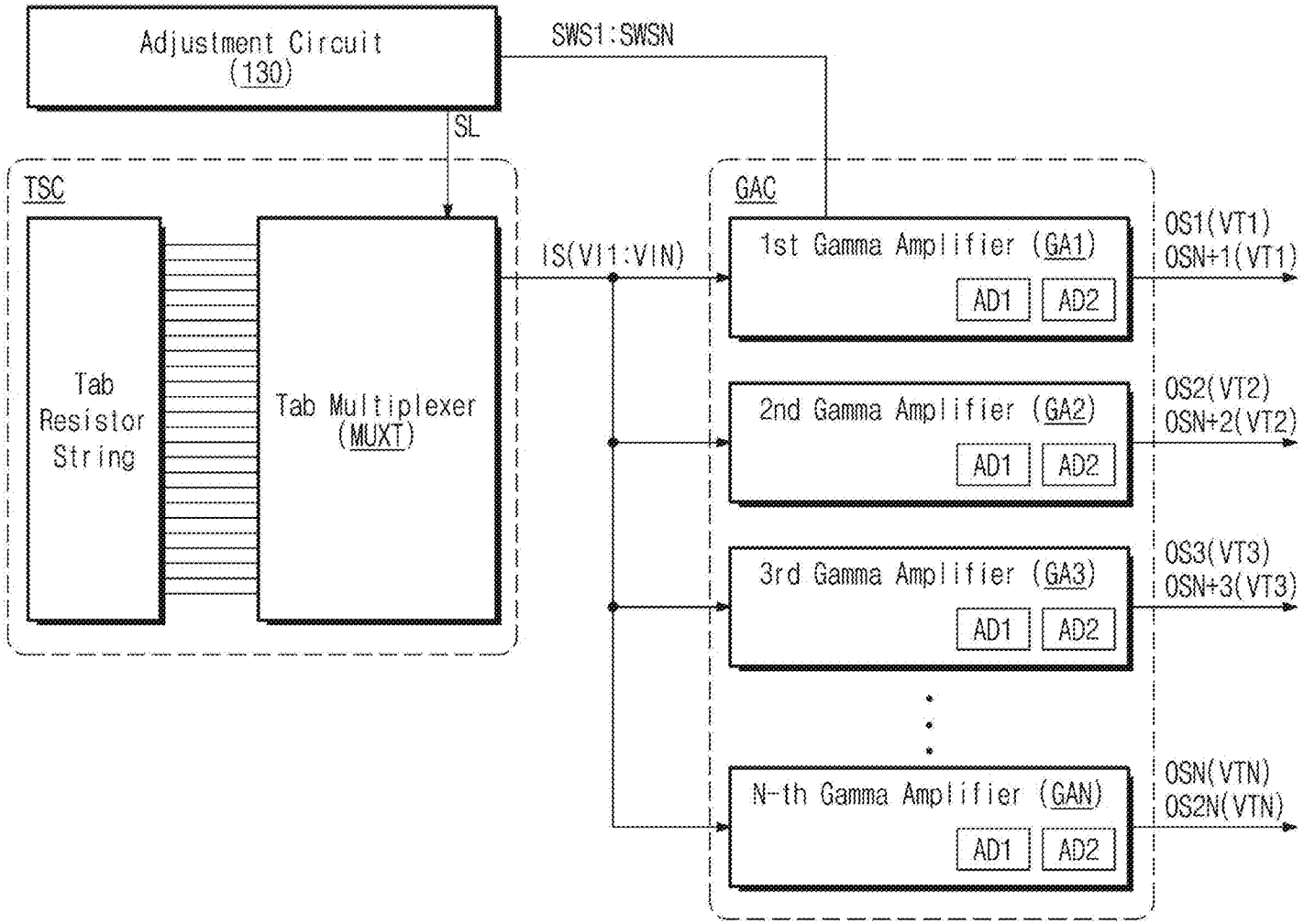
FIG. 11 is a block diagram of a gamma voltage generator according to some embodiments of the present disclosure.

FIG. 11 is a block diagram of a gamma voltage generator according to some embodiments of the present disclosure. The gamma voltage generator 100 according to some embodiments of the present disclosure will be described with reference to FIG. 11. The gamma voltage generator 100 may correspond to the gamma voltage generator 100 of FIGS. 1, 2, and 3.

In some embodiments, the gamma voltage generator 100 may repeatedly operate during a full-cycle period, and the full-cycle period may include first to 2N-th time periods. Here, "N" may be an arbitrary natural number and may be equal to the number of gamma amplifiers included in the gamma amplification circuit GAC.

The gamma voltage generator 100 may include the tab selection circuit TSC, the gamma amplification circuit GAC, and the adjustment circuit 130. The adjustment circuit 130 may output the selection signal SL to the tab selection circuit TSC. The adjustment circuit 130 may output first to N-th switch set control signals SWS1 to SWSN to the gamma amplification circuit GAC.

The tab selection circuit TSC may include the tab resistor string and the tab multiplexer MUXT. Depending on the selection signal SL, the tab multiplexer MUXT may determine (or select) first to N-th input voltage levels VI1 to YIN of a plurality of voltage levels divided by the tab resistor string and may generate the input signal IS. The input signal IS may have the first to N-th input voltage levels VI1 to VIN that are sequentially repeated over time.

For example, in the case where the gamma voltage generator 100 respectively operates during the full-cycle period, the input signal IS may have the first to N-th input voltage levels VI1 to VIN during first to N-th time periods of the first to 2N-th time periods and may have the first to N-th input voltage levels VI1 to VIN during (N+1)-th to 2N-th time periods of the first to 2N-th time periods.

The gamma amplification circuit GAC may include first to N-th gamma amplifiers GA1 to GAN. The first to N-th gamma amplifiers GA1 to GAN may receive the input signal IS from the tab selection circuit TSC. The first to N-th gamma amplifiers GA1 to GAN may receive the first to N-th switch set control signals SWS1 to SWSN from the adjustment circuit 130, respectively. Each of the first to N-th gamma amplifiers GA1 to GAN may include the first amplification device AD1 and the second amplification device AD2.

The first to N-th gamma amplifiers GA1 to GAN may respectively generate output signals each having the first to N-th gamma tab voltage levels VT1 to VTN, based on the corresponding switch set control signal of the first to N-th switch set control signals SWS1 to SWSN and the input signal IS.

For example, in the case where the gamma voltage generator 100 respectively operates during the full-cycle period, the first amplification device AD1 of the first gamma amplifier GA1 may receive the input signal IS having the first input voltage level VI1 during the first time period of the first to 2N-th time periods and may generate the first output signal OS1 having the first gamma tab voltage level VT1 during the second to (N+1)-th time periods. The second amplification device AD2 of the first gamma amplifier GA1 may receive the input signal IS having the first input voltage level VI1 during the (N+1)-th time period of the first to 2N-th time periods and may generate an (N+1)-th output signal OSN+1 having the first gamma tab voltage level VT1 during the (N+2)-th to 2N-th time periods and a first time period in a next full-cycle period.

As in the above description, because the first and second amplification devices AD1 and AD2 of the second gamma amplifier GA2 operate to be complementary, the first and second amplification devices AD1 and AD2 may generate the second output signal OS2 having the second gamma tab voltage level VT2 and the (N+2)-th output signal OSN+2 having the second gamma tab voltage level VT2, respectively. Because the first and second amplification devices AD1 and AD2 of the third gamma amplifier GA3 operate to be complementary, the first and second amplification devices AD1 and AD2 may generate a third output signal OS3 having the third gamma tab voltage level VT3 and an (N+3)-th output signal OSN+3 having the third gamma tab voltage level VT3, respectively. Because the first and second amplification devices AD1 and AD2 of the N-th gamma amplifier GAN operate to be complementary, the first and second amplification devices AD1 and AD2 may generate an N-th output signal OSN having the N-th gamma tab voltage level VTN and a 2N-th output signal OS2N having the N-th gamma tab voltage level VTN, respectively.

Figure 12:
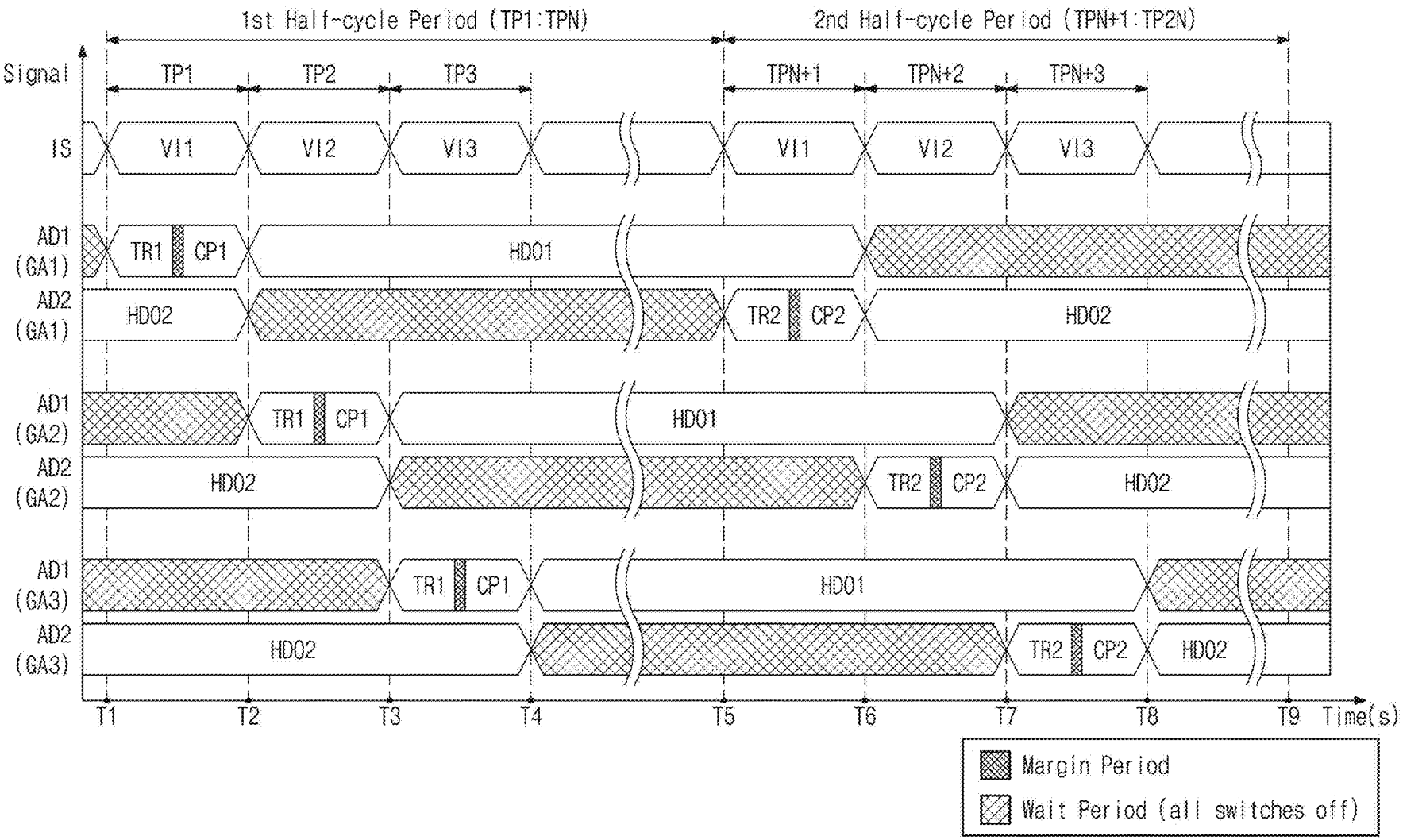
FIG. 12 is a graph describing an input signal and a control signal of a gamma voltage generator of FIG. 11 according to some embodiments of the present disclosure.

FIG. 12 is a graph describing an input signal and a control signal of a gamma voltage generator of FIG. 11 according to some embodiments of the present disclosure. In FIG. 12, a horizontal axis represents a time, and a vertical axis represents information of a signal. Referring to FIGS. 11 and 12, the gamma voltage generator 100 may repeatedly operate during the full-cycle period. The full-cycle period may be a time period from a first time point T1 to a ninth time point T9 and may be repeated.

The full-cycle period may include a first half-cycle period and a second half-cycle period. The first half-cycle period may include first to N-th time periods TP1 to TPN. The second half-cycle period may include (N+1)-th to 2N-th time periods TPN+1 to TP2N. When the second half-cycle period ends, operations in the first half-cycle period may again be performed. Likewise, before the first half-cycle period starts, operations in the second half-cycle period may be already performed. In some embodiments, the first to 2N-th time periods TP1 to TP2N of FIG. 12 may have the same length.

The first time period TP1 may be a time period from a first time point T1 to a second time point T2. In the first time period TP1, the first amplification device AD1 of the first gamma amplifier GA1 may receive the input signal IS having the first input voltage level VI1 during the first track period TR1. All switches of the first amplification device AD1 of the first gamma amplifier GA1 may be turned off during a margin period. The first amplification device AD1 of the first gamma amplifier GA1 may compensate for an offset voltage during the first compensation period CP1.

In the first time period TP1, the second amplification device AD2 of the first gamma amplifier GA1 may generate the (N+1)-th output signal OSN+1 having the first gamma tab voltage level VT1, based on the input signal IS received in a previous time period. That is, the first time period TP1 may be included in the second hold-out period HDO2 of the second amplification device AD2 of the first gamma amplifier GA1.

In the first time period TP1, the first amplification device AD1 of the second gamma amplifier GA2 may operate in a wait mode. The wait mode may refer to an operating mode in which all switches of an amplification device are turned off. That is, all switches of the first amplification device AD1 of the second gamma amplifier GA2 may be turned off.

In the first time period TP1, the second amplification device AD2 of the second gamma amplifier GA2 may generate the (N+2)-th output signal OSN+2 having the second gamma tab voltage level VT2, based on the input signal IS received in a previous time period.

In the first time period TP1, the first amplification device AD1 of the third gamma amplifier GA3 may operate in the wait mode. That is, all switches of the first amplification device AD1 of the third gamma amplifier GA3 may be turned off.

In the first time period TP1, the second amplification device AD2 of the third gamma amplifier GA3 may generate the (N+3)-th output signal OSN+3 having the third gamma tab voltage level VT3, based on the input signal IS received in a previous time period.

Next, the second time period TP2 may be a time period from the second time point T2 to a third time point T3. In the second time period TP2, the first amplification device AD1 of the first gamma amplifier GA1 may generate the first output signal OS1 having the first gamma tab voltage level VT1, based on the input signal IS received in the first time period TP1. That is, the second time period TP2 may be included in the first hold-out period HDO1 of the first amplification device AD1 of the first gamma amplifier GA1.

In the second time period TP2, the second amplification device AD2 of the first gamma amplifier GA1 may operate in the wait mode.

In the second time period TP2, the first amplification device AD1 of the second gamma amplifier GA2 may receive the input signal IS having the second input voltage level VI2 during the first track period TR1. All the switches of the first amplification device AD1 of the second gamma amplifier GA2 may be turned off during the margin period. The first amplification device AD1 of the second gamma amplifier GA2 may compensate for an offset voltage during the first compensation period CP1.

In the second time period TP2, the second amplification device AD2 of the second gamma amplifier GA2 may generate the (N+2)-th output signal OSN+2 having the second gamma tab voltage level VT2, based on the input signal IS received in a previous time period.

In the second time period TP2, the first amplification device AD1 of the third gamma amplifier GA3 may operate in the wait mode. That is, all the switches of the first amplification device AD1 of the third gamma amplifier GA3 may be turned off.

In the second time period TP2, the second amplification device AD2 of the third gamma amplifier GA3 may generate the (N+3)-th output signal OSN+3 having the third gamma tab voltage level VT3, based on the input signal IS received in a previous time period.

Then, the third time period TP3 may be a time period from the third time point T3 to a fourth time point T4. In the third time period TP3, the first amplification device AD1 of the first gamma amplifier GA1 may generate the first output signal OS1 having the first gamma tab voltage level VT1, based on the input signal IS received in the first time period TP1.

In the third time period TP3, the second amplification device AD2 of the first gamma amplifier GA1 may operate in the wait mode.

In the third time period TP3, the first amplification device AD1 of the second gamma amplifier GA2 may generate the second output signal OS2 having the second gamma tab voltage level VT2, based on the input signal IS received in the second time period TP2.

In the third time period TP3, the second amplification device AD2 of the second gamma amplifier GA2 may operate in the wait mode.

In the third time period TP3, the first amplification device AD1 of the third gamma amplifier GA3 may receive the input signal IS having the third input voltage level VI3 during the first track period TR1. All the switches of the first amplification device AD1 of the third gamma amplifier GA3 may be turned off during the margin period. The first amplification device AD1 of the third gamma amplifier GA3 may compensate for an offset voltage during the first compensation period CP1.

In the third time period TP3, the second amplification device AD2 of the third gamma amplifier GA3 may generate the (N+3)-th output signal OSN+3 having the third gamma tab voltage level VT3, based on the input signal IS received in a previous time period.

In FIG. 12, the (N+1)-th time period TPN+1 may be a time period from a fifth time point T5 to a sixth time point T6. In the (N+1)-th time period TPN+1, the first amplification device AD1 of the first gamma amplifier GA1 may generate the first output signal OS1 having the first gamma tab voltage level VT1, based on the input signal IS received in the first time period TP1.

In the (N+1)-th time period TPN+1, the second amplification device AD2 of the first gamma amplifier GA1 may receive the input signal IS having the first input voltage level VI1 during the second track period TR2. All switches of the second amplification device AD2 of the first gamma amplifier GA1 may be turned off during the margin period. The second amplification device AD2 of the first gamma amplifier GA1 may compensate for an offset voltage during the second compensation period CP2.

In the (N+1)-th time period TPN+1, the first amplification device AD1 of the second gamma amplifier GA2 may generate the second output signal OS2 having the second gamma tab voltage level VT2, based on the input signal IS received in the second time period TP2.

In the (N+1)-th time period TPN+1, the second amplification device AD2 of the second gamma amplifier GA2 may operate in the wait mode.

In the (N+1)-th time period TPN+1, the first amplification device AD1 of the third gamma amplifier GA3 may generate the third output signal OS3 having the third gamma tab voltage level VT3, based on the input signal IS received in the third time period TP3.

In the (N+1)-th time period TPN+1, the second amplification device AD2 of the third gamma amplifier GA3 may operate in the wait mode.

In FIG. 12, the (N+2)-th time period TPN+2 may be a time period from the sixth time point T6 to a seventh time point T7. In the (N+2)-th time period TPN+2, the first amplification device AD1 of the first gamma amplifier GA1 may operate in the wait mode.

In the (N+2)-th time period TPN+2, the second amplification device AD2 of the first gamma amplifier GA1 may generate the (N+1)-th output signal OSN+1 having the first gamma tab voltage level VT1, based on the input signal IS received in the (N+1)-th time period TPN+1.

In the (N+2)-th time period TPN+2, the first amplification device AD1 of the second gamma amplifier GA2 may generate the second output signal OS2 having the second gamma tab voltage level VT2, based on the input signal IS received in the second time period TP2.

In the (N+2)-th time period TPN+2, the second amplification device AD2 of the second gamma amplifier GA2 may receive the input signal IS having the second input voltage level VI2 during the second track period TR2. All switches of the second amplification device AD2 of the second gamma amplifier GA2 may be turned off during the margin period. The second amplification device AD2 of the second gamma amplifier GA2 may compensate for an offset voltage during the second compensation period CP2.

In the (N+2)-th time period TPN+2, the first amplification device AD1 of the third gamma amplifier GA3 may generate the third output signal OS3 having the third gamma tab voltage level VT3, based on the input signal IS received in the third time period TP3.

In the (N+2)-th time period TPN+2, the second amplification device AD2 of the third gamma amplifier GA3 may operate in the wait mode.

In FIG. 12, the (N+3)-th time period TPN+3 may be a time period from the seventh time point T7 to an eighth time point T8. In the (N+3)-th time period TPN+3, the first amplification device AD1 of the first gamma amplifier GA1 may operate in the wait mode.

In the (N+3)-th time period TPN+3, the second amplification device AD2 of the first gamma amplifier GA1 may generate the (N+1)-th output signal OSN+1 having the first gamma tab voltage level VT1, based on the input signal IS received in the (N+1)-th time period TPN+1.

In the (N+3)-th time period TPN+3, the first amplification device AD1 of the second gamma amplifier GA2 may operate in the wait mode.

In the (N+3)-th time period TPN+3, the second amplification device AD2 of the second gamma amplifier GA2 may generate the (N+2)-th output signal OSN+2 having the second gamma tab voltage level VT2, based on the input signal IS received in the (N+2)-th time period TPN+2.

In the (N+3)-th time period TPN+3, the first amplification device AD1 of the third gamma amplifier GA3 may generate the third output signal OS3 having the third gamma tab voltage level VT3, based on the input signal IS received in the third time period TP3.

In the (N+3)-th time period TPN+3, the second amplification device AD2 of the third gamma amplifier GA3 may receive the input signal IS having the third input voltage level VI3 during the second track period TR2. All switches of the second amplification device AD2 of the third gamma amplifier GA3 may be turned off during the margin period. The second amplification device AD2 of the third gamma amplifier GA3 may compensate for an offset voltage during the second compensation period CP2.

Figure 13:
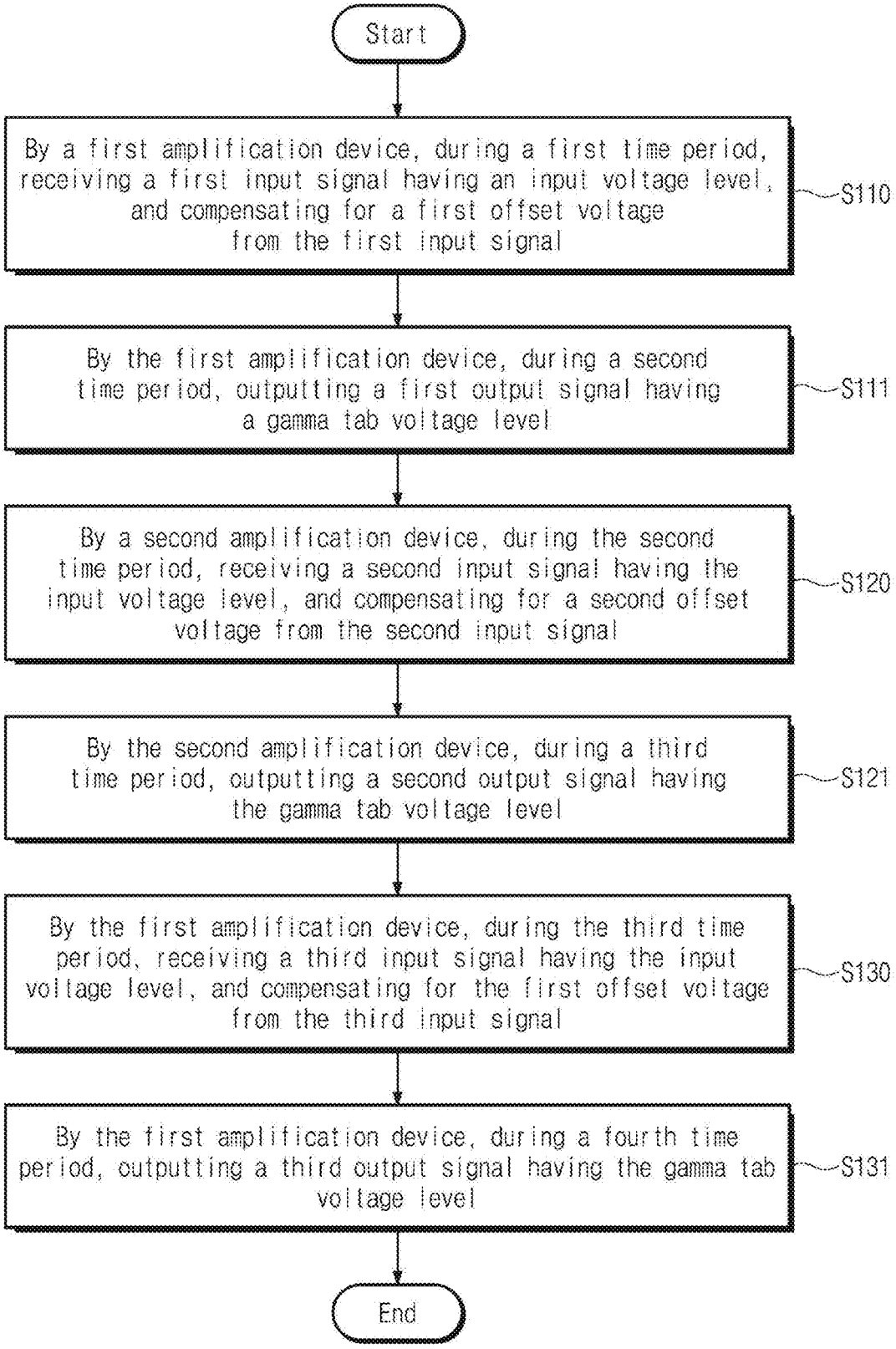
FIG. 13 is a flowchart describing an operating method of a gamma amplifier according to some embodiments of the present disclosure.

FIG. 13 is a flowchart describing an operating method of a gamma amplifier according to some embodiments of the present disclosure. An operating method of a gamma amplifier according to some embodiments of the present disclosure will be described with reference to FIG. 13. The gamma amplifier may correspond to the gamma amplifier of FIG. 8. The gamma amplifier may include a first amplification device and a second amplification device.

In operation S110, during a first time period, the first amplification device may receive a first input signal having an input voltage level and may compensate for a first offset voltage from the first input signal. The first offset voltage may be an offset voltage of an amplifier in the first amplification device.

In operation S111, the first amplification device may output a first output signal having a gamma tab voltage level during a second time period.

In operation S120, during the second time period, the second amplification device may receive a second input signal having the input voltage level and may compensate for a second offset voltage from the second input signal. The second offset voltage may be an offset voltage of an amplifier in the second amplification device.

In operation S121, the second amplification device may output a second output signal having the gamma tab voltage level during a third time period.

In operation S130, during the third time period, the first amplification device may receive a third input signal having the input voltage level and may compensate for the first offset voltage from the third input signal. Operation S130 may correspond to operation S110.

In operation S131, the first amplification device may output a third output signal having the gamma tab voltage level during a fourth time period. Operation S131 may correspond to operation S111.

Figure 14:
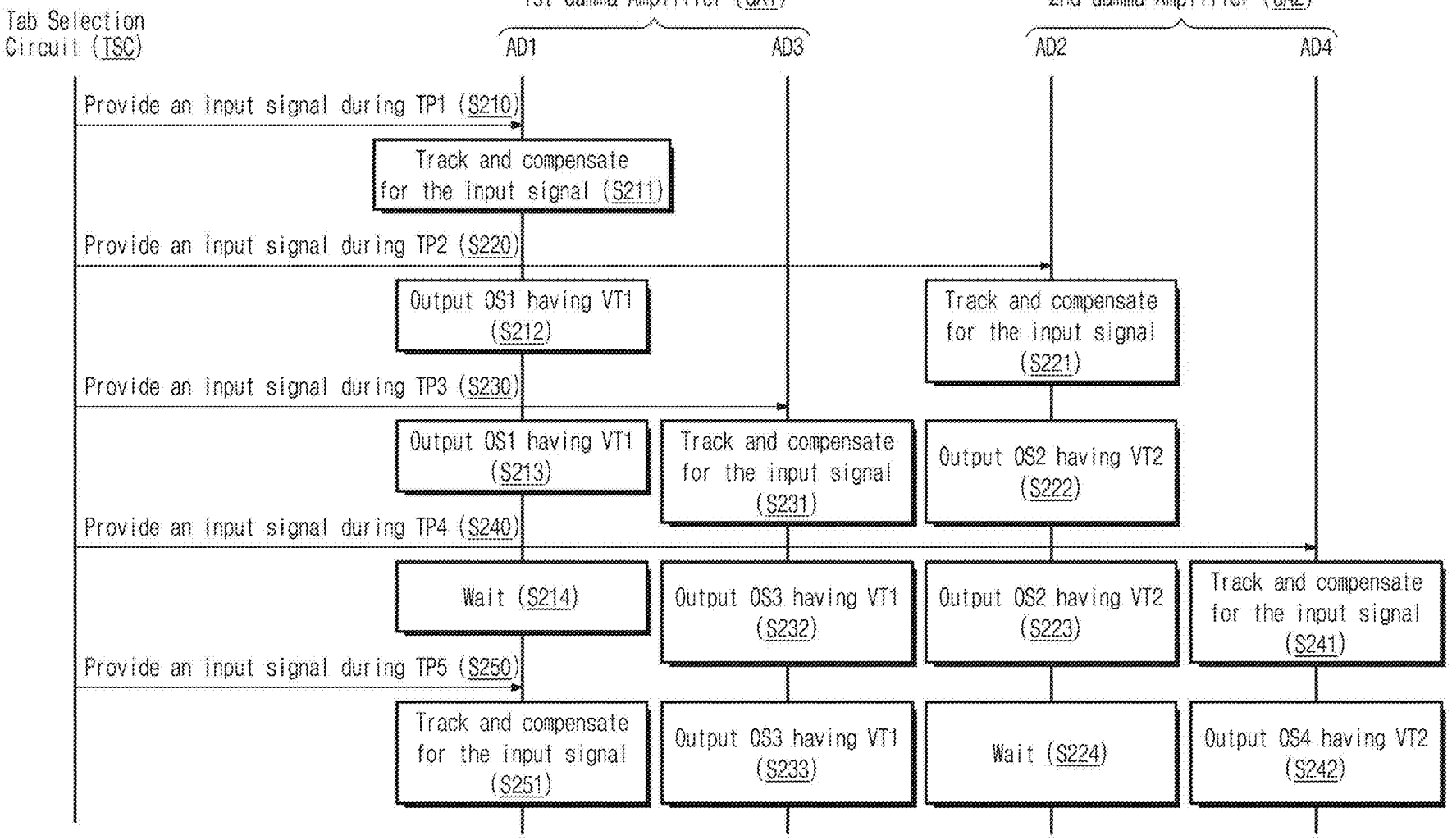
FIG. 14 is a flowchart describing an operation method of a gamma voltage generator according to some embodiments of the present disclosure.

FIG. 14 is a flowchart describing an operation method of a gamma voltage generator according to some embodiments of the present disclosure. An operating method of a gamma voltage generator according to some embodiments of the present disclosure will be described with reference to FIG. 14. The gamma voltage generator may correspond to the gamma voltage generator 100 of FIGS. 1, 2, 3, and 11. The gamma voltage generator may include the tab selection circuit TSC, the first gamma amplifier GA1, and the second gamma amplifier GA2. The first gamma amplifier GA1 may include a first amplification device AD1 and a third amplification device AD3. The second gamma amplifier GA2 may include a second amplification device AD2 and a fourth amplification device AD4.

In operation S210, the tab selection circuit TSC may provide an input signal to the first amplification device AD1 of the first gamma amplifier GA1 during a first time period TP1. The input signal may have a first input voltage level during the first time period TP1. In operation S211, the first amplification device AD1 may track the input signal and may compensate for an offset voltage from the tracked input signal. In operation S212, the first amplification device AD1 may output a first output signal OS1 having a first gamma tab voltage level VT1. In operation S213, the first amplification device AD1 may continue to output the first output signal OS1. In operation S214, the first amplification device AD1 may operate in a wait mode.

In operation S220, the tab selection circuit TSC may provide an input signal to the second amplification device AD2 of the second gamma amplifier GA2 during a second time period TP2. The input signal may have a second input voltage level during the second time period TP2. In operation S221, the second amplification device AD2 may track the input signal and may compensate for an offset voltage from the tracked input signal. In operation S222, the second amplification device AD2 may output a second output signal OS2 having a second gamma tab voltage level VT2. In operation S223, the second amplification device AD2 may continue to output the second output signal OS2. In operation S224, the second amplification device AD2 may operate in the wait mode.

In operation S230, the tab selection circuit TSC may provide an input signal to the third amplification device AD3 of the first gamma amplifier GA1 during a third time period TP3. The input signal may have the first input voltage level during the third time period TP3. In operation S231, the third amplification device AD3 may track the input signal and may compensate for an offset voltage from the tracked input signal. In operation S232, the third amplification device AD3 may output a third output signal OS3 having the first gamma tab voltage level VT1. In operation S233, the third amplification device AD3 may continue to output the third output signal OS3.

In operation S240, the tab selection circuit TSC may provide an input signal to the fourth amplification device AD4 of the second gamma amplifier GA2 during a fourth time period TP4. The input signal may have the second input voltage level during the fourth time period TP4. In operation S241, the fourth amplification device AD4 may track the input signal and may compensate for an offset voltage from the tracked input signal. In operation S242, the fourth amplification device AD4 may output a fourth output signal OS4 having the second gamma tab voltage level VT2.

In operation S250, the tab selection circuit TSC may provide an input signal to the first amplification device AD1 of the first gamma amplifier GA1 during a fifth time period TP5. The input signal may have the first input voltage level during the fifth time period TP5. Operation S250 may correspond to operation S210. In operation S251, the first amplification device AD1 may track the input signal and may compensate for an offset voltage from the tracked input signal. Operation S251 may correspond to operation S211.

In some embodiments, the first gamma amplifier GA1 and the second gamma amplifier GA2 may operate in parallel, the first amplification device AD1 and the third amplification device AD3 of the first gamma amplifier GA1 may operate to be complementary, and the second amplification device AD2 and the fourth amplification device AD4 of the second gamma amplifier GA2 may operate to be complementary.

For example, operation S210 and operation S211 may correspond to the first time period. Operation S220, operation S212, and operation S221 may correspond to the second time period. Operation S230, operation S213, operation S231, and operation S222 may correspond to the third time period. Operation S240, operation S214, operation S232, operation S223, and operation S241 may correspond to the fourth time period. Operation S250, operation S251, operation S233, operation S224, and operation S242 may correspond to the fifth time period.

According to an embodiment of the present disclosure, a gamma amplifier including a track period of receiving an input signal having an input voltage level and a gamma voltage generator including the gamma amplifier are provided.

Also, the gamma voltage generator that compensates for an offset voltage of the gamma amplifier such as an image quality is improved and allows gamma amplifiers to share an input signal such that a chip size is reduced and power consumption is reduced is provided.

Additionally, the timing controller 11, adjustment circuit 130 and/or the components included therein may include processing circuitry such as hardware including logic circuits; a hardware/software combination such as a processor executing software; or a combination thereof. For example, the processing circuity may include, but is not limited to, a central processing unit (CPU), a memory controller, an arithmetic logic unit (ALU), a digital signal processor, a microcomputer, a field programmable gate array (FPGA), and programmable logic unit, a microprocessor, application-specific integrated circuit (ASIC), etc.

While the present disclosure has been described with reference to embodiments thereof, it will be apparent to those of ordinary skill in the art that various changes and modifications may be made thereto without departing from the spirit and scope of the present disclosure as set forth in the following claims.

What is claimed is:

1. An apparatus comprising:

a first amplification device configured to receive a first input signal having an input voltage level during a first track period in a first time period, to compensate for a first offset voltage from the first input signal during a first compensation period in the first time period based on a control signal, and to generate a first output signal having a gamma tab voltage level during a second time period after the first time period based on the control signal;

a second amplification device configured to receive a second input signal having the input voltage level during a second track period in the second time period, to compensate for a second offset voltage from the second input signal during a second compensation period in the second time period based on the control signal, and to generate a second output signal having the gamma tab voltage level during a third time period after the second time period based on the control signal; and processing circuitry configured to generate the control signal and control when the first input signal and the second input signals are received by the first amplification device and the second amplification device, respectively.

2. The apparatus of claim 1, wherein the processing circuitry is further configured to control when the first input signal is received by the first amplification device such that the first amplification device does not receive the first input signal during the first compensation period and the second time period, and the processing circuitry is further configured to control when the second input signal is received by the second amplification device such that the second amplification device does not receive the second input signal during the second compensation period and the third time period.

3. The apparatus of claim 1, wherein the first amplification device is further configured to receive a third input signal having the input voltage level during a third track period in the third time period, compensate for the first offset voltage from the third input signal during a third compensation period in the third time period based on the control signal, and generate a third output signal having the gamma tab voltage level during a fourth time period after the third time period based on the control signal, and the processing circuitry is configured to control when the third input signal is received by the first amplification device.

4. The apparatus of claim 1, wherein the first amplification device includes:

a first switch connected between a first node and an input node arranged for receiving the first input signal during the first track period;

a first capacitor connected between the first node and a second node;

a second switch connected between the second node and a third node;

a third switch connected between the first node and the third node;

a fourth switch connected between the first node and an output node and arranged for outputting the first output signal during the second time period based on the control signal;

a fifth switch connected between the third node and the output node; and a first amplifier including a first input terminal connected with the second node, a second input terminal arranged for receiving an amplification reference voltage, and a first output terminal connected with the third node.

5. The apparatus of claim 4, wherein the first and second switches are configured to be turned on during the first track period based on the control signal, the third switch is configured to be turned on during the first compensation period based on the control signal, and the fourth and fifth switches are configured to be turned on during the second time period based on the control signal.

6. The apparatus of claim 5, wherein the first to fifth switches are configured to be turned off during a margin period between the first track period and the first compensation period based on the control signal.

7. The apparatus of claim 4, wherein the first offset voltage corresponds to a difference between a voltage level of the first input terminal of the first amplifier and a voltage level of the first output terminal of the first amplifier.

8. The apparatus of claim 4, wherein the second amplification device includes:

a sixth switch connected between a fourth node and the input node arranged for further receiving the second input signal during the second track period;

a second capacitor connected between the fourth node and a fifth node;

a seventh switch connected between the fifth node and a sixth node;

an eighth switch connected between the fourth node and the sixth node;

a ninth switch connected between the fourth node and the output node and arranged for further outputting the second output signal during the third time period based on the control signal;

a tenth switch connected between the sixth node and the output node; and a second amplifier including a third input terminal connected with the fifth node, a fourth input terminal arranged for receiving the amplification reference voltage, and a second output terminal connected with the sixth node.

9. The apparatus of claim 8, wherein the sixth and seventh switches are configured to be turned on during the second track period based on the control signal, wherein the eighth switch is configured to be turned on during the second compensation period based on the control signal, and wherein the ninth and tenth switches are configured to be turned on during the third time period based on the control signal.

10. A apparatus comprising:

a first switch connected between a first node and an input node arranged for receiving a first input signal having an input voltage level during a first track period in a first time period and configured to be turned on during the first track period based on a control signal;

a first capacitor connected between the first node and a second node;

a second switch connected between the second node and a third node and configured to be turned on during the first track period based on the control signal;

a third switch connected between the first node and the third node and further configured to be turned on during a first compensation period following the first track period and belonging to the first time period based on the control signal;

a fourth switch connected between the first node and an output node arranged for outputting a first output signal having a gamma tab voltage level during a second time period after the first time period and configured to be turned on during the second time period based on the control signal;

a fifth switch connected between the third node and the output node and configured to be turned on during the second time period based on the control signal;

a first amplifier including a first input terminal connected with the second node, a second input terminal arranged for receiving an amplification reference voltage, and a first output terminal connected with the third node; and processing circuitry configured to generate the control signal and control when the first input signal is received at the input node.

11. The apparatus of claim 10, further comprising:

a sixth switch connected between a fourth node and the input node arranged for further receiving a second input signal having the input voltage level during a second track period in the second time period and configured to be turned on during the second track period based on the control signal;

a second capacitor connected between the fourth node and a fifth node;

a seventh switch connected between the fifth node and a sixth node and configured to be turned on during the second track period based on the control signal;

an eighth switch connected between the fourth node and the sixth node and configured to be turned on during a second compensation period following the second track period and belonging to the second time period based on the control signal;

a ninth switch connected between the fourth node and the output node arranged for further outputting a second output signal having the gamma tab voltage level during a third time period after the second time period and configured to be turned on during the third time period based on the control signal;

a tenth switch connected between the sixth node and the output node and configured to be turned on during the third time period based on the control signal; and a second amplifier including a third input terminal connected with the fifth node, a fourth input terminal arranged for receiving the amplification reference voltage, and a second output terminal connected with the sixth node, wherein the processing circuitry is further configured to control when the second input signal is received at the input node.

12. The apparatus of claim 11, wherein the first and second switches are further configured to be turned on during a third track period in the third time period based on the control signal, the third switch is further configured to be turned on during a third compensation period following the third track period and belonging to the third time period based on the control signal; and the fourth and fifth switches are further configured to be turned on during a fourth time period after the third time period based on the control signal.

13. The apparatus of claim 11, wherein the first switch is further configured to be turned off during the first compensation period and the second time period based on the control signal, and wherein the sixth switch is further configured to be turned off during the second compensation period and the third time period based on the control signal.

14. The apparatus of claim 11, wherein the first to fifth switches are further configured to be turned off during a first margin period between the first track period and the first compensation period based on the control signal, and wherein the sixth to tenth switches are further configured to be turned off during a second margin period between the second track period and the second compensation period based on the control signal.

15. The apparatus of claim 10, wherein the first capacitor is configured to:

accumulate a voltage corresponding to a difference between the input voltage level and an offset voltage level through the first switch and the second switch during the first track period, and compensate for a voltage level of the third node, based on the accumulated voltage, during the first compensation period.

16. An apparatus comprising:

a tab selection circuit configured to generate an input signal having first to N-th input voltage levels respectively in first to N-th time periods of first to 2N-th time periods and having the first to N-th input voltage levels respectively in the (N+1)-th to 2N-th time periods of the first to 2N-th time periods;

first to N-th gamma amplifiers configured to operate based on the input signal, a first gamma amplifier of the first to N-th gamma amplifiers including a first amplification device configured to receive the input signal during a first track period in the first time period of the first to 2N-th time periods and to generate a first output signal having a first gamma tab voltage level during the second to (N+1)-th time periods of the first to 2N-th time periods based on a control signal; and a second amplification device configured to receive the input signal during a (N+1)-th track period in the (N+1)-th time period of the first to 2N-th time periods and to generate a second output signal having the first gamma tab voltage level during the first time period and the (N+2)-th to 2N-th time periods of the first to 2N-th time periods based on the control signal; and processing circuitry configured to generate the control signal, wherein the first to 2N-th time periods are sequentially repeated, and wherein "N" is a natural number.

17. The apparatus of claim 16, wherein a second gamma amplifier of the first to N-th gamma amplifiers includes:

a third amplification device configured to receive the input signal during a second track period in the second time period of the first to 2N-th time periods and to generate a third output signal having a second gamma tab voltage level during the third to (N+2)-th time periods of the first to 2N-th time periods based on the control signal; and a fourth amplification device configured to receive the input signal during a (N+2)-th track period in the (N+2)-th time period of the first to 2N-th time periods and to generate a fourth output signal having the second gamma tab voltage level during the first and second time periods and the (N+3)-th to 2N-th time periods of the first to 2N-th time periods based on the control signal.

18. The apparatus of claim 17, wherein a third gamma amplifier of the first to N-th gamma amplifiers includes:

a fifth amplification device configured to receive the input signal during a third track period in the third time period of the first to 2N-th time periods and to generate a fifth output signal having a third gamma tab voltage level during the fourth to (N+3)-th time periods of the first to 2N-th time periods based on the control signal; and a sixth amplification device configured to receive the input signal during a (N+3)-th track period in the (N+3)-th time period of the first to 2N-th time periods and to generate a sixth output signal having the third gamma tab voltage level during the first to third time periods and the (N+4)-th to 2N-th time periods of the first to 2N-th time periods based on the control signal.

19. The apparatus of claim 16, wherein the first amplification device includes a first switch connected between a first node and an input node arranged for receiving the input signal, a first capacitor connected between the first node and a second node, a second switch connected between the second node and a third node, a third switch connected between the first node and the third node, a fourth switch connected between the first node and an output node arranged for outputting the first output signal, a fifth switch connected between the third node and the output node, and a first amplifier including a first input terminal connected with the second node, a second input terminal arranged for receiving an amplification reference voltage, and a first output terminal connected with the third node, wherein the second amplification device includes a sixth switch connected between the input node and a fourth node, a second capacitor connected between the fourth node and a fifth node, a seventh switch connected between the fifth node and a sixth node, an eighth switch connected between the fourth node and the sixth node, a ninth switch connected between the fourth node and an output node arranged for further outputting the second output signal, a tenth switch connected between the sixth node and the output node, and a second amplifier including a third input terminal connected with the fifth node, a fourth input terminal arranged for receiving the amplification reference voltage, and a second output terminal connected with the sixth node, and the fifth switch and the tenth switch operate to be complementary based on the control signal.

20. The apparatus of claim 19, wherein the first and second switches are configured to be turned on during the first track period based on the control signal, the third switch is configured to be turned on during a first compensation period following the first track period and belonging to the first time period based on the control signal, the fourth and fifth switches are configured to be turned on during the second to (N+1)-th time periods based on the control signal, the sixth and seventh switches are configured to be turned on during the (N+1)-th track period based on the control signal, the eighth switch is configured to be turned on during a (N+1)-th compensation period following the (N+1)-th track period and belonging to the (N+1)-th time period based on the control signal, and wherein the ninth and tenth switches are configured to be turned on during the first time period and the (N+2)-th to 2N-th time periods based on the control signal.

* * * * *